US008794616B2

(12) United States Patent
Matsuki et al.

(10) Patent No.: US 8,794,616 B2
(45) Date of Patent: Aug. 5, 2014

(54) SHEET POST-PROCESSING APPARATUS AND IMAGE FORMING APPARATUS USING THE SAME

(75) Inventors: Satoru Matsuki, Minamikoma-gun (JP); Yuji Kunugi, Minamiarupusu (JP); Ikuhiro Obata, Fuefuki (JP); Kazunori Hatakawa, Kai (JP); Hiroto Akiyama, Kofu (JP); Tsukasa Kondo, Kofu (JP); Tatsuya Shimizu, Nirasaki (JP)

(73) Assignee: Nisca Corporation, Minamikoma-gun, Yamanshi-ken (JP)

( * ) Notice: Subject to any disclaimer, the term of this patent is extended or adjusted under 35 U.S.C. 154(b) by 407 days.

(21) Appl. No.: 13/137,806

(22) Filed: Sep. 14, 2011

(65) Prior Publication Data

US 2013/0063743 A1 Mar. 14, 2013

(51) Int. Cl.
*B65H 37/04* (2006.01)
*G03G 15/00* (2006.01)

(52) U.S. Cl.
CPC .. *G03G 15/6544* (2013.01); *G03G 2215/00793* (2013.01); *G03G 2215/00818* (2013.01); *G03G 15/6582* (2013.01)
USPC ..... 270/58.07; 270/58.14; 270/58.15; 399/407; 399/410

(58) Field of Classification Search
CPC ..... B65H 37/04
USPC ..... 270/58.07, 58.08, 58.14, 58.15; 399/407, 410
See application file for complete search history.

(56) References Cited

U.S. PATENT DOCUMENTS

| | | | | |
|---|---|---|---|---|
| 5,592,881 | A * | 1/1997 | Rabjohns | 101/483 |
| 6,647,243 | B2 * | 11/2003 | Sato et al. | 399/407 |
| 7,080,830 | B2 * | 7/2006 | Suzuki et al. | 270/58.08 |
| 7,657,205 | B2 * | 2/2010 | Kang | 399/110 |
| 7,894,746 | B2 * | 2/2011 | Waugerman et al. | 399/110 |
| 8,233,175 | B2 * | 7/2012 | Richards et al. | 358/1.15 |
| 2003/0198494 | A1 * | 10/2003 | Kenji et al. | 399/381 |
| 2006/0210337 | A1 * | 9/2006 | Nagata et al. | 399/407 |
| 2008/0018040 | A1 * | 1/2008 | Tamura et al. | 271/3.14 |
| 2008/0265483 | A1 * | 10/2008 | Herrmann | 270/58.08 |
| 2008/0298867 | A1 * | 12/2008 | Watanabe et al. | 399/407 |
| 2009/0062096 | A1 * | 3/2009 | Sasahara | 493/396 |
| 2010/0019446 | A1 * | 1/2010 | Matsumoto et al. | 271/302 |

FOREIGN PATENT DOCUMENTS

| | | |
|---|---|---|
| JP | 2006-219224 | 8/2006 |
| JP | 2006-248686 | 9/2006 |

* cited by examiner

*Primary Examiner* — Patrick Mackey
(74) *Attorney, Agent, or Firm* — Manabu Kanesaka

(57) ABSTRACT

A sheet post-processing apparatus includes a first unit having a guide device for guiding a sheet, a second unit having a first post-processing device for performing post-processing on the sheet, and a third unit having a second post-processing device for loading sheets and performing post-processing on the sheets in bunch form placed on the processing tray. A first coupling device is provided for coupling the first unit and at least one of the second and third units. A second coupling device is provided for coupling the second unit and the third unit. The second unit and the third unit are capable of being pulled out in the sheet carrying-out direction with respect to the first unit by releasing the first coupling device. The entire or front side of the second unit is shiftable to the first unit side with respect to the third unit by releasing the second coupling device.

20 Claims, 33 Drawing Sheets

SHEET POST-PROCESSING APPARATUS AND IMAGE FORMING APPARATUS USING THE SAME

BACKGROUND OF THE INVENTION AND RELATED ART STATEMENT

1. Field of the Invention

The present invention relates to a sheet post-processing apparatus for performing post-processing such as punching, stamping, bunch alignment, paper binding and paper folding on sheets carried out of an image forming apparatus such as a copier and printer, and an image forming apparatus using the sheet post-processing apparatus, and more specifically, to a sheet post-processing apparatus that is most suitable for being installed and used in space provided in the main body of the image forming apparatus.

2. Description of the Prior Art

Generally, with the progression of multifunction in the image forming apparatus, sheet post-processing apparatuses which perform post-processing on printed sheets are being developed. In such a sheet post-processing apparatus, for example, a sheet is subjected to first post-processing such as a punching and stamping using a punching apparatus and a stamping apparatus, the sheets are then made in bunch form, the bunches are displaced alternately in position and discharged in a bunch shift (JOG) mechanism, or the sheets in bunch form are bound using a stapler apparatus, or adhesive apply apparatus, the processed sheets are further subjected to paper folding such as two-folding and three-folding, the sheets are thus subjected to the second post-processing, and the processed sheet bunch selectively subjected to some post-processing is stored in a collection tray. Then, such a sheet post-processing apparatus, which is installed with each unit of a wide variety of post-processing apparatuses and upsized, is connected to the side of the image forming apparatus and used.

In recent years, for example, as disclosed in Patent Document 1 (Japanese Patent Application Publication No. 2006-248686), the sheet post-processing apparatus itself is configured in a compact size, is not connected to the side of the image forming apparatus, but is capable of being installed in space provided in the image forming apparatus, and such a sheet post-processing apparatus is becoming widespread.

The image forming apparatus is equipped with an apparatus body in the shape of a U provided with space in the center portion, and a compact sheet post-processing apparatus inside the space provided in the center portion. In addition, in contrast to the sheet post-processing apparatus connected to the side of the image forming apparatus, such a sheet post-processing apparatus which is installed in the image forming apparatus comprised of a U-shaped apparatus body is so-called the in-body finisher.

Further, as distinct from the above-mentioned sheet post-processing apparatus which is installed with a wide variety of post-processing apparatuses and is upsized, in the sheet post-processing apparatus as disclosed in Patent Document 1, post-processing units with a high frequency are selected corresponding to a use environment where the apparatus is installed, the selected post-processing units are connected, and the compact size is thereby attained. More specifically, in this case, the apparatus is comprised of a punch unit for punching holes in predetermined portions of a sheet carried out of the main-body apparatus when necessary, a staple unit which loads sheets passed through the punch unit in bunch form in an intermediate collection part and binds the loaded sheet bunch with staples, and a collection tray which stores and collects the sheet bunch which is subjected to binding processing in the staple unit and discharged. Meanwhile, the punch unit is attached to the post-processing apparatus frame side, and the staple unit is attached to the post-processing apparatus frame to be able to slide in the sheet carrying-out direction with respect to the fixed and supported punch unit. Further, the collection tray capable of moving up and down is attached to the stapler unit.

Further, as well as Patent Document 1, Japanese Patent Application Publication No. 2006-219224 is also known.

However, in the image forming apparatus as described in above-mentioned Patent Document 1, there is a case that a sheet remains in the sheet post-processing apparatus or in a transport path in front of the apparatus. Then, the removal operation of the remaining sheet varies with the remaining position of the remaining sheet. For example, when a sheet remains in the transport path in front of the sheet post-processing apparatus, the sheet is not removed only by pulling out the staple unit from the apparatus body, the punch unit, which is beforehand installed to be capable of being pulled out toward the front in the direction perpendicular to the sheet transport direction, is pulled out, a lower guide plate of a pair of upper and lower guide plates constituting the transport path is opened downward with space between the punch unit and the transport path opened, and the sheet remaining in the path is removed. Meanwhile, when a sheet remains in a transport path of the sheet post-processing apparatus, a joint between the staple unit and the apparatus body is released, the staple unit is slid and pulled out, clearance is thereby created between the staple unit and the punch unit, and it is possible to remove the remaining sheet from the clearance.

In an image forming apparatus provided with such a sheet post-processing apparatus, there are two technical problems as described below.

First, as the first problem, in the structure in which only the staple unit is supported slidably with respect to the apparatus body and pulled out with the punch unit left on the apparatus body side, in removing a sheet left in front of the above-mentioned sheet post-processing apparatus, the structure needs to enable the punch unit to be pulled out to the front side with respect to the apparatus body, and a slide mechanism specific to the punch unit is required. Such a mechanism does not only impair the compact feature, but also leads to a tendency to tilt up and down by pulling out in the direction perpendicular to the sheet carrying-out direction, a sheet guide surface of the punch unit is inclined with respect to the sheet carrying-out guide plane by the tilt, the sheet passage distance is narrowed on either the front side or the back side by the inclination, and as a result, such a narrowed portion causes a carrying-out sheet to be caught therein and becomes the factor of the remaining.

Further, as the second problem, when the punch unit is pulled out toward the front side in the direction perpendicular to the sheet carrying-out direction and the above-mentioned remaining sheet is removed, the transport path in which the remaining sheet is present hides at the back of the punch unit that is pulled out to the front side, the operator peeps through an opening opened by pulling out the staple unit, and needs to pull the remaining sheet out of the transport path hiding at the back of the opening to remove, and the work is not only difficult to perform but also lacks safety because the operator inserts his/her hand while folding in removing the remaining sheet and the hand comes into contact with other parts.

OBJECT OF THE INVENTION

The present invention was made in view of the aforementioned problems of conventional techniques, and it is an object of the invention to provide a sheet post-processing apparatus which can be installed in limited space of an image forming apparatus, enables movement space given inside the limited space to be differently used sophisticatedly corresponding to the content of processing such as the above-mentioned removal of a remaining sheet, removal of punching wastes, and replenishment of staples, and thereby enables the processing to be performed with extreme ease, and further provide an image forming apparatus provided with the sheet post-processing apparatus.

SUMMARY OF THE INVENTION

To solve the above-mentioned problems, a sheet post-processing apparatus as described in claim 1 of the invention is comprised of a first unit provided with guide means for guiding a sheet that is sequentially carried in, a second unit provided with first post-processing means for performing post-processing on the sheet that is sequentially carried out of the first unit, and a third unit provided with a processing tray to load sheets that are sequentially carried out through the second unit, second post-processing means for performing post-processing on the sheets in bunch form placed on the processing tray, and a collection tray disposed on the downstream side of the processing tray to store the sheets subjected to the post-processing, where the first, second and third units are successively provided parallel in the sheet carrying-out direction, the apparatus further has first coupling means for coupling the first unit and at least one of the second unit and third unit, and second coupling means for coupling the second unit and the third unit, and it is configured that the second unit and the third unit are capable of being pulled out in the sheet carrying-out direction with respect to the first unit by releasing the first coupling means, and that the entire or front side of the second unit is capable of shifting to the first unit side with respect to the third unit by releasing the second coupling means.

Further, in the aforementioned sheet post-processing apparatus as described in claim 1, the sheet post-processing apparatus as described in claim 2 of the invention reserves clearance opened widely between the first unit and the second unit located in a pull-out position, has shift inhibiting means for inhibiting shift of the second unit to the first unit side due to release of the second coupling means, and is configured so that the second unit and the third unit are pulled out in the sheet carrying-out direct ion by releasing the first coupling means, the second unit and the third unit are held in pull-out positions by the shift inhibiting means, and that the entire or front side of the second unit released by the second coupling means is capable of shifting to the first unit side after releasing inhibition of the shift inhibiting means.

Furthermore, in the sheet post-processing apparatus as described in claim 3 of the invention, in the aforementioned sheet post-processing apparatus as described in claim 2, the guide means of the first unit is comprised of a pair of guide plates for guiding the frontside and backside of the carried-in sheet, and a pair of transport rollers that are supported by the pair of guide plates to be mutually rotatable and that nip and transport the carried-in sheet, and is configured so that a guide plate on the second unit side of the pair of guide plates is opened in conjunction with inhibition release of the shift inhibiting means so as to release a nip of the pair of transport rollers.

Still furthermore, in the sheet post-processing apparatus as described in claim 4 of the invention, in the above-mentioned sheet post-processing apparatus as described in claims 1 and 2, it is configured that the second unit and the third unit are supported to be movable by a pair of front and back guide rails provided in parallel with each other in the sheet carrying-out direction, and that the second unit separates parallel from the third unit by releasing the second coupling means.

Moreover, in the sheet post-processing apparatus as described in claim 5 of the invention, in the above-mentioned sheet post-processing apparatus as described in claim 1, it is configured that the second unit and the third unit are mutually supported on their rear side swingably by a hinge mechanism, the second unit is supported on its front side by a lock mechanism to be capable of being coupled/released to/from the third unit, and that one of the second unit and the third unit is provided with releasing means for releasing coupling of the lock mechanism.

Further, in the aforementioned sheet post-processing apparatus as described in claim 5, the sheet post-processing apparatus as described in claim 6 of the invention reserves clearance opened widely between the first unit and the second unit located in the pull-out position, and has shift inhibiting means for inhibiting open on the front side of the second unit to the first unit side due to coupling release of the second coupling means, where it is configured that the second unit and the third unit are pulled out in the sheet carrying-out direction by coupling release of the first coupling means, the second unit and the third unit are held in the pull-out positions by the shift inhibiting means, and that open on the front side of the second unit coupling-released by the second coupling means is capable of being created after releasing inhibition of the shift inhibiting means.

Furthermore, in the sheet post-processing apparatus as described in claim 7 of the invention, in the above-mentioned sheet post-processing apparatus as described in claim 5, the first post-processing means is a punching apparatus, and by opening the front side of the second unit to the first unit side, storage space is provided which enables a punching waste box to be installed in a substantially center portion of the inclined punching apparatus, from the downstream side in the sheet carrying-out direction and the front side.

Still furthermore, in the aforementioned sheet post-processing apparatus as described in claim 7, the sheet post-processing apparatus as described in claim 8 of the invention reserves clearance opened widely between the first unit and the second unit located in the pull-out position, and has shift inhibiting means for inhibiting open on the front side of the second unit to the first unit side due to coupling release of the second coupling means, and it is configured that open on the front side of the second unit coupling-released by the second coupling means is created by releasing hold of the shift inhibiting means, and that the punching waste box is capable of being removed from the storage space.

Moreover, in the sheet post-processing apparatus as described in claim 9 of the invention, in the above-mentioned sheet post-processing apparatus as described in claim 8, the second post-processing means is a stapler apparatus comprised of a main body of a stapler and a staple storing portion detachable from the main body, the stapler apparatus has a shift mechanism that shifts to the front side of the apparatus by a replenishment signal (end, near end, manual) of staples of the staple storing portion, and it is configured that with the front side of the second unit coupling-released by the second coupling means opened widely by releasing hold of the shift inhibiting means, the staple storing portion of the stapler apparatus is capable of being removed from the opened front side.

Further, in the sheet post-processing apparatus as described in claim 10 of the invention, in the above-mentioned sheet post-processing apparatus as described in claim 5, it is configured that the second unit and the third unit are mutually supported on their rear side swingably by a hinge mechanism, the second unit is supported on its front side by a lock mechanism to be capable of being coupled/released to/from the third unit, and that one of the second unit and the third unit is provided with releasing means for releasing coupling of the lock mechanism.

To solve the above-mentioned problems, in the sheet post-processing apparatus as described in claim 11 of the invention, the first unit in the sheet post-processing apparatus as described in claim 1 is provided with sheet transport means having a sheet transport roller pair comprised of a driving roller and a driven roller that are capable of coming into press-contact and separating with/from each other on the upstream side in the sheet transport direction for transporting the sheet, and sheet allocating means for allocating the sheet to a post-processing transport path or a switchback transport path at a branch point for branching the post-processing transport path for guiding the sheet to the post-processing section on the downstream side in the sheet transport direction, and the switchback transport path for receiving the sheet which is fed from the sheet carry-in entrance by the forward/backward rotation roller and is returned by switchback, and control means having first control means for switching the allocating means to the post-processing transport path side while bringing the sheet transport roller pair into press-contact, and second control means for switching the allocating means to the switchback transport path side while separating the sheet transport roller pair.

Further, in the sheet post-processing apparatus as described in claim 12 of the invention, the first unit in the above-mentioned sheet post-processing apparatus as described in claim 1 is provided with sheet transport means having a sheet transport roller pair comprised of a driving roller and a driven roller that are capable of coming into press-contact and separating with/from each other on the upstream side in the sheet transport direction for transporting the sheet, a first branch point for branching a post-processing transport path for feeding the sheet to the post-processing section on the downstream side in the sheet transport direction, and a non-post-processing transport path for discharging the sheet without feeding to the post-processing section, a second branch point for branching the non-post-processing transport path and a switchback transport path for receiving the sheet which is fed from the sheet carry-in entrance by the forward/backward rotation roller and is returned by switchback, and sheet allocating means comprised of first allocating means provided at the first branch point to allocate the sheet to the post-processing transport path and the non-post-processing transport path, and second allocating means provided at the second branch point to allocate the sheet to the non-post-processing transport path and the switchback transport path, and control means having first control means for switching the allocating means to the post-processing transport path side while bringing the sheet transport roller pair into press-contact, and second control means for switching the allocating means to the switchback transport path side while separating the sheet transport roller pair.

Furthermore, in the above-mentioned sheet post-processing apparatus as described in claim 11, the sheet post-processing apparatus as described in claim 13 of the invention has a forward/backward rotation motor that rotates forward and backward by the control means, and rotation direction converting means for converting both forward rotation and backward rotation of the driving means into a rotation direction for rotating the driving roller in the sheet transport direction, and is provided with driving means in which the first control means rotates the forward/backward rotation motor forward to switch the allocating means to the post-processing transport path side, while bringing the sheet transport roller pair into press-contact to rotate the driving roller in the sheet transport direction, and the second control means rotates the forward/backward rotation motor backward to switch the allocating means to the switchback transport path side, while separating the sheet transport roller pair to rotate the driving roller in the sheet transport direction.

Still furthermore, in the sheet post-processing apparatus as described in claim 14 of the invention, in the above-mentioned sheet post-processing apparatus as described in claim 13, the rotation direction converting means is comprised of two one-way clutches coupled to the rotary shaft that supports the driving roller of the sheet transport roller pair and the forward/backward rotation motor to drive, where in the two one-way clutches, when the forward/backward rotation motor rotates forward, one of the clutches conveys the rotation to the rotary shaft to drive and rotate the driving roller in the sheet carrying-out direction, while the other clutch idles, and when the forward/backward rotation motor rotates backward, one of the clutches idles, while the other clutch conveys the rotation to the rotary shaft to drive and rotate the driving roller in the sheet carrying-out direction.

Moreover, in the sheet post-processing apparatus as described in claim 15 of the invention, in the above-mentioned sheet post-processing apparatus as described in claim 13, the driving means is provided with a coupling mechanism for coupling the allocating means for switching the sheet to the switchback transport path side and the forward/backward rotation motor to drive, and the coupling mechanism is comprised of a one-way clutch that idles by forward rotation of the forward/backward rotation motor, while being driven by backward rotation of the forward/backward rotation motor, a strike member and a torque limiter that regulate a swing range of the one-way clutch being driven by backward rotation of the forward/backward rotation motor, cam means for slaving by rotation of the one-way clutch, and a swing lever that swings by the cam means to drive the allocating means.

Further, in the sheet post-processing apparatus as described in claim 16 of the invention, in the above-mentioned sheet post-processing apparatus as described in claim 11, the coupling means separates the driven roller from the driving roller by backward rotation of the forward/backward rotation motor.

Further, an image forming apparatus as described in claim 17 of the invention has a configuration provided with a main body of the image forming apparatus provided with a paper feed section that sequentially feeds sheets on a stacker, a printing section that performs predetermined print on a sheet from the paper feed section, a fusing section that heats and fuses ink on the sheet fed from the printing section, and a sheet discharge section that sequentially carries the sheet from the fusing section out of a sheet discharge outlet, an image reading apparatus that is disposed above the main body of the image forming apparatus to read an original image set on a platen, and a sheet post-processing apparatus comprised of a first unit provided with guide means for guiding the sheet that is sequentially carried in from the main body of the image forming apparatus, a second unit provided with first post-processing means for performing post-processing on the sheet that is sequentially carried out of the first unit, and a third unit provided with a processing tray to load sheets that are sequentially carried out through the second unit, second post-processing means for performing post-processing on the sheets in bunch form placed on the processing tray, and a collection tray disposed on the downstream side of the processing tray to store the sheets subjected to the post-processing, where the first, second and third units are successively provided parallel in the sheet carrying-out direction, the sheet post-processing apparatus further has first coupling means for coupling the first unit and at least one of the second unit and third unit, and second coupling means for coupling the second unit and the third unit, the second unit and the third unit are capable of being pulled out in the sheet carrying-out direction with respect to the first unit by releasing the first coupling means, and the entire or front side of the second unit shifts to the first unit side with respect to the third unit by releasing the second coupling means.

Furthermore, in the aforementioned image forming apparatus as described in claim 17, the image forming apparatus as described in claim 18 of the invention reserves clearance opened widely between the first unit and the second unit located in a pull-out position, and has shift inhibiting means for inhibiting open on the front side of the second unit to the first unit side due to release of the second coupling means, where it is configured that the second unit and the third unit are pulled out in the sheet carrying-out direction by releasing the first coupling means, the second unit and the third unit are stopped in pull-out positions by the shift inhibiting means, and that the entire or front side of the second unit released by the second coupling means shifts to the first unit side after releasing inhibition of the shift inhibiting means.

Still furthermore, in the image forming apparatus as described in claim 19 of the invention, in the above-mentioned image forming apparatus as described in claim 17, the image forming apparatus is configured so that an original reading section is disposed above the main body of the apparatus, the paper feed section is disposed below the main body of the apparatus, the printing section is disposed between the original reading section and the paper feed section, the sheet post-processing apparatus provided with a sheet discharge section is disposed in a space portion of the main body of the apparatus formed by the original reading section, the printing section and the paper feed section, a transport path exit of a switchback transport path for two-side printing is formed on the top face of the sheet post-processing apparatus, and that in two-side printing, a sheet with printing on its one side is drawn back again after a transport front end portion of the sheet is sent to the top face of a sheet post-processing section from the transport path exit so as to undergo switchback transport, where the sheet post-processing apparatus has the above-mentioned configuration as described in claim 11.

Effect of the Invention

In the sheet post-processing apparatus as described in claim 1 of the invention, the apparatus is provided with the first coupling means for coupling the first unit and at least one of the second unit and third unit, and the second coupling means for coupling the second unit and the third unit, it is configured that the second unit and the third unit are capable of being pulled out in the sheet carrying-out direction with respect to the first unit by releasing the first coupling means, and that the entire or front side of the second unit is capable of shifting to the first unit side with respect to the third unit by releasing the second coupling means, the second unit is shifted as appropriate in the space opened widely from the first unit, it is thereby possible to use one limited space sophisticatedly, and the following effects are exhibited.

First, by pulling out the second unit in the sheet carrying-out direction together with the third unit, the space from the first unit is opened widely without pulling out the second unit to the front as in the conventional manner, it is possible to remove a remaining sheet while viewing the first unit from the front without the second unit interfering with the sight, and it is thus possible to perform the operation safely with ease.

Second, when a sheet remains in between the first unit and the second unit, there is a fear of damaging the remaining sheet by pulling out the second unit in the direction perpendicular to the sheet carrying-out direction as in the conventional manner. In contrast thereto, even when the apparatus halts during punching, it is possible to pull out the remaining sheet under punching in the sheet carrying-out direction concurrently with pulling out the second unit, and there is no fear of damaging the remaining sheet.

Third, by pulling out the second unit in the sheet carrying-out direction with respect to the main body of the apparatus that fixes and supports the first unit, it is possible to support the front side and back side of the second unit in parallel with the main body of the apparatus, and as compared with the conventional structure for pulling out the second unit in the direction perpendicular to the sheet carrying-out direction and supporting only the back side, it is possible to suppress the inclination of the second unit with respect to the first unit, and to reduce the remaining rate of carrying-out sheet.

Further, the sheet post-processing apparatus as described in claim 2 of the invention reserves clearance opened widely between the first unit and the second unit located in a pull-out position, has the shift inhibiting means for inhibiting shift of the second unit to the first unit side due to release of the second coupling means, and is configured so that the second unit and the third unit are pulled out in the sheet carrying-out direction by releasing the first coupling means, the second unit and the third unit are held in pull-out positions by the shift inhibiting means, and that the entire or front side of the second unit released by the second coupling means is capable of shifting to the first unit side after releasing inhibition of the shift inhibiting means. By this means, the second unit and the third unit are pulled out in the sheet carrying-out direction from the first unit, are held in pull-out positions by the shift inhibiting means, and therefore, do not move during the processing for removing the sheet remaining in the first unit, and it is possible to perform the operation for removing the remaining sheet safely.

Furthermore, in the sheet post-processing apparatus as described in claim 3 of the invention, the guide means of the first unit is comprised of a pair of guide plates for guiding the frontside and the backside of the carried-in sheet, and a pair of transport rollers that are supported by the pair of guide plates to be mutually rotatable and that nip and transport the carried-in sheet, and is configured so that a guide plate on the second unit side of the pair of guide plates is opened in conjunction with inhibition release of the shift inhibiting means so as to release a nip of the pair of transport rollers. Therefore, by operating only the shift inhibiting means, it is possible to perform holding the second unit and the third unit in pull-out positions and opening the guide plate concurrently, and to ensure safety reliably without operation error.

Still furthermore, in the sheet post-processing apparatus as described in claim 4 of the invention, the second unit and the third unit are supported to be movable by a pair of front and back guide rails provided in parallel with each other in the sheet carrying-out direction, the second unit separates parallel from the third unit by releasing the second coupling means, it is thereby possible to use the pair of front and back guide rails for both the shift of the second unit and the shift of the third unit, and the shift mechanism is simplified. Further, by shifting and supporting on the same guide rails, the second unit and the third unit are kept parallel, and do not cause displacement from each other, and it is possible to couple and release the second coupling means with reliability.

Moreover, in the sheet post-processing apparatus as described in claim 5 of the invention, it is configured that the second unit and the third unit are mutually supported on their rear side swingably by a hinge mechanisms, the second unit is supported on its front side by a lock mechanism to be capable of being coupled/released to/from the third unit, and that one of the second unit and the third unit is provided with releasing means for releasing coupling of the lock mechanism, and therefore, the following effects are exhibited.

First, at least one end portion of the second unit is capable of being always fixed and supported to/by the third unit, the coupling position between the second unit and the third unit is always maintained, the second unit and the third unit do not cause displacement from each other, and it is possible to couple and release the second coupling means with reliability.

Second, if the second unit is shifted so that the front side and the back side are parallel with each other, for example, attachment and detachment of a waste box, cartridge of stamp ink or the like is crank insertion for inserting in clearance between the second unit and the third unit while at the same time, pressing to the second unit side. In contrast thereto, the open amount is increased corresponding to a slant on the front side by swing-opening on the front side, it is further possible to visually check directly the insertion portion to insert the waste box, cartridge of stamp ink or the like from the front, and to insert the waste box, cartridge of stamp ink or the like by putting straightly from the front side to the back side, and the operability is enhanced.

Further, the sheet post-processing apparatus as described in claim 6 of the invention reserves clearance opened widely between the first unit and the second unit located in the pull-out position, and has shift inhibiting means for inhibiting open on the front side of the second unit to the first unit side due to coupling release of the second coupling means, where it is configured that the second unit and the third unit are pulled out in the sheet carrying-out direction by coupling release of the first coupling means, the second unit and the third unit are held in pull-out positions by the shift inhibiting means, and that open on the front side of the second unit coupling-released by the second coupling means is capable of being created after releasing inhibition of the shift inhibiting means. By this means, the second unit and the third unit are pulled out in the sheet carrying-out direction from the first unit, are held in pull-out positions by the shift inhibiting means, and therefore, do not move during the processing for removing the sheet remaining in the first unit, and it is possible to perform the operation for removing the remaining sheet safely.

Furthermore, in the sheet post-processing apparatus as described in claim 7 of the invention, the first post-processing means is a punching apparatus, and by opening the front side of the second unit to the first unit side, storage space is provided which enables a punching waste box to be installed in a substantially center portion of the inclined punching apparatus, from the downstream side in the sheet carrying-out direction and the front side. Therefore, by opening the front side of the second unit to the first unit side, the punching waste box storage portion is inclined aslant, the storage space of the punching waste box storage portion is wide and viewable, it is possible to directly insert the punching waste box in the storage space from the front side, and the removal operation of the punching waste box is made ease.

Still furthermore, the sheet post-processing apparatus as described in claim 8 of the invention reserves clearance opened widely between the first unit and the second unit located in the pull-out position, and has shift inhibiting means for inhibiting open on the front side of the second unit to the first unit side due to coupling release of the second coupling means, where it is configured that open on the front side of the second unit coupling-released by the second coupling means is created by releasing hold of the shift inhibiting means, and that the punching waste box is capable of being removed from the storage space. By this means, there is no fear of opening widely the front side of the second unit accidentally during removal of a sheet remaining in the first unit, and it is possible to ensure a high degree of safety.

Moreover, in the sheet post-processing apparatus as described in claim 9 of the invention, the second post-processing means is a stapler apparatus comprised of a main body of a stapler and a staple storing portion detachable from the main body, the staple apparatus has a shift mechanism that shifts to the front side of the apparatus by a replenishment signal (end, near end, manual) of staples of the staple storing portion, and it is configured so that with the front side of second unit coupling-released by the second coupling means opened widely by releasing hold of the shift inhibiting means, the staple storing portion of the stapler apparatus is capable of being removed from the opened front side. By this means, with the front side of the second unit opened widely, it is possible to perform the processing together with the operation on the second unit side, and the operability is excellent.

Further, in the sheet post-processing apparatus as described in claim 10 of the invention, it is configured that the second unit and the third unit are mutually supported on their rear side swingably by a hinge mechanism, the second unit is supported on its front side by a lock mechanism to be capable of being coupled/released to/from the third unit, and that one of the second unit and the third unit is provided with releasing means for releasing coupling of the lock mechanism, and therefore, the following effects are exhibited.

First, at least one end portion of the second unit is capable of being always fixed and supported to/by the third unit, the coupling position between the second unit and the third unit is always maintained, the second unit and the third unit do not cause displacement from each other, and it is possible to couple and release the second coupling means with reliability.

Second, if the second unit is shifted so that the front side and the back side are parallel with each other, for example, attachment and detachment of a waste box, cartridge of stamp ink or the like is crank insertion for inserting in clearance between the second unit and the third unit while at the same time, pressing to the second unit side. In contrast thereto, the open amount is increased corresponding to a slant on the front side by swing-opening on the front side, it is further possible to visually check directly the insertion portion to insert the waste box, cartridge of stamp ink or the like from the front, and to insert the waste box, cartridge of stamp ink or the like by putting straightly from the front side to the back side, and the operability is enhanced.

Further, according to the above-mentioned inventions as described in claims 11 and 12, when the image forming apparatus coupled to the sheet post-processing apparatus reverses the sheet by switchback using the switchback transport path of the sheet post-processing apparatus, press-contact of the sheet transport roller pair is released concurrently with switching the allocating means of the switchback path, the sheet reversed by switchback by the image forming apparatus is thereby not pulled between the sheet post-processing apparatus and the image forming apparatus, smooth switchback transport is allowed, and it is possible to provide the sheet post-processing apparatus that reliably prevents the image quality from deteriorating and a jam from occurring.

Furthermore, according to the above-mentioned invention as described in claim 13, by simply rotating the forward/backward rotation motor backward, it is possible to release press-contact of the sheet transport roller pair concurrently with switching the allocating means of the switchback transport path, the open mechanism of the switchback path is easy, and further, by rotating the driving roller in the sheet transport direction using the rotation direction converting means with the switchback transport path opened, it is possible to feed the sheet without the front end portion of the sheet fed to the switchback transport path sticking to the driving roller.

Still furthermore, according to the above-mentioned invention as described in claim 14, since the rotation direction converting means is comprised of two one-way clutches, driving coupling adjustments of the driving transmission system are not required, and the mechanism is simplified.

Moreover, according to the above-mentioned invention as described in claim 15, the coupling mechanism is comprised of the one-way clutch, torque limiter, cam means and swing lever, the rotation of the forward/backward rotation motor is converted into reciprocating rotation motion within a predetermined range by the cam means using the one-way clutches and torque limiter, the swing lever is swung by the reciprocating rotation motion, and it is thus possible to switch the allocating means with reliability.

Further, according to the above-mentioned invention as described in claim 16, it is possible to separate the driven roller from the driving roller using the coupling mechanism for switching the allocating means concurrently with switching the allocating means, separation of the driven roller is synchronized with switching of the allocating means, and it is possible to reliably open the switchback transport path without timing adjustments.

Furthermore, in the image forming apparatus as described in claims 17 and 18 of the invention, by installing the above-mentioned sheet post-processing apparatus as described in claims 1 and 2, it is possible to provide the image forming apparatus which has the above-mentioned effects of the sheet post-processing apparatus as described in claims 1 and 2, is excellent in compact performance, and is further rich in safety.

Moreover, according to the above-mentioned invention as described in claim 19, the sheet post-processing apparatus is provided with the switchback transport path, the image forming apparatus switches back and reverses the sheet using the switchback transport path, and therefore, by effectively using the space of the sheet post-processing apparatus, it is possible to make the image forming apparatus compact.

DETAILED DESCRIPTION OF PREFERRED EMBODIMENT

Figure 1:
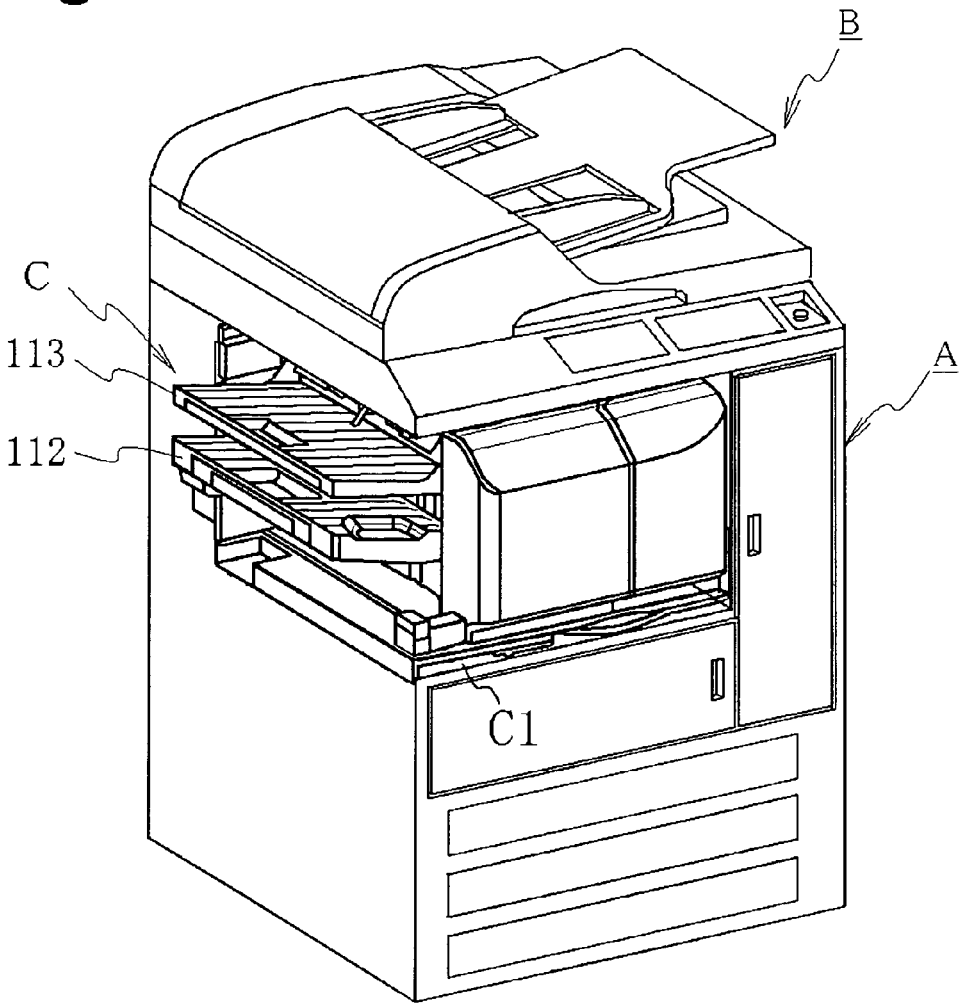
FIG. 1 is an appearance perspective view showing a state in which a sheet post-processing apparatus according to the invention is stored in an image forming apparatus.
Figure 2:
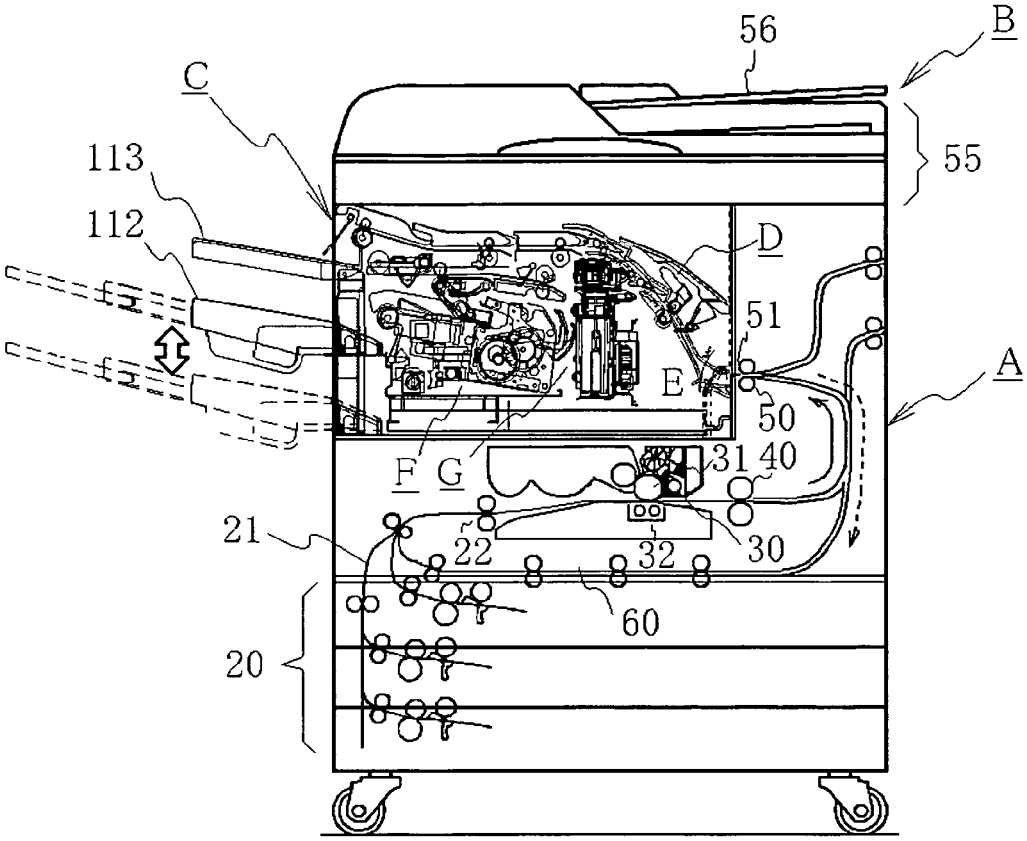
FIG. 2 is a plan sectional view of FIG. 1.
Figure 3:
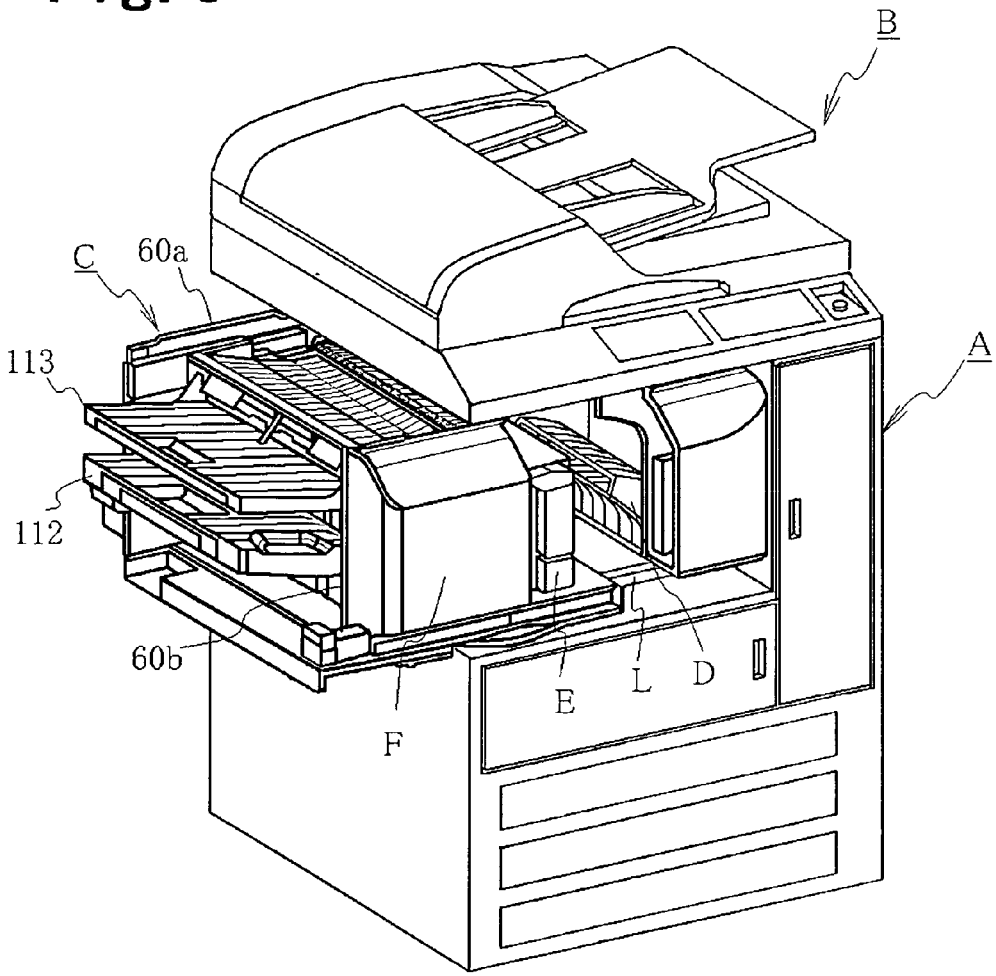
FIG. 3 is an appearance perspective view showing a state in which the sheet post-processing apparatus according to the invention is pulled out of the image forming apparatus.
Figure 4:
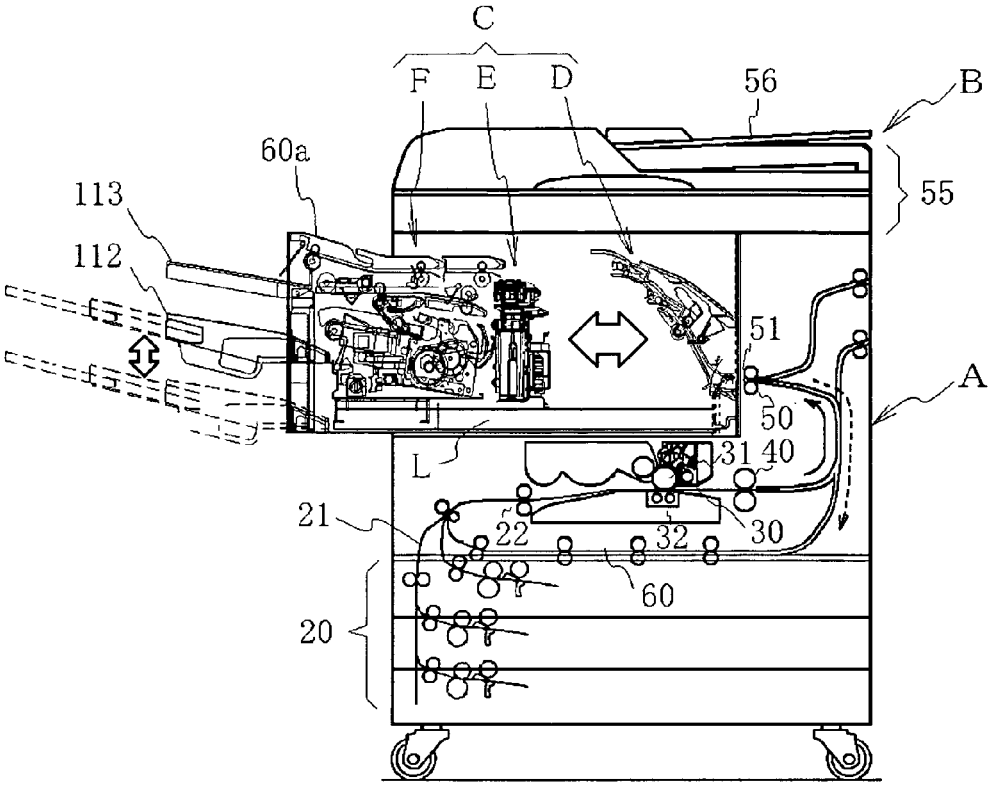
FIG. 4 is a plan sectional view of FIG. 3.

The present invention will specifically be described below based on preferred Embodiments shown in figures. FIG. 1 is an appearance perspective view showing a state in which a sheet post-processing apparatus according to the invention is stored in an image forming apparatus. FIG. 2 is a plan sectional view of FIG. 1. FIG. 3 is an appearance perspective view showing a state in which the sheet post-processing apparatus according to the invention is pulled out of the image forming apparatus. FIG. 4 is a plan sectional view of FIG. 3. Then, as shown in FIGS. 1 to 4, the image forming apparatus is comprised of an image forming unit A forming the main body of the image forming apparatus, an image reading unit B forming an image reading apparatus, and a post-processing unit C forming the sheet post-processing apparatus of the application concerned.

[Image Forming Unit Configuration]

First, in the image forming unit A, into an exterior casing 10 are integrated a paper feed section 20, printing section 30, fusing section 40, sheet discharge section 50 and two-side reversing section 60, and as the configuration, various configurations are known in copiers, printers and the like. The paper feed section 20 as shown in the figure is comprised of paper feed cassettes, and paper feed rollers which separate and feed sheets in the paper feed cassettes on a sheet-by-sheet basis. In the section 20 shown in the figure, a plurality of paper feed cassettes stores sheets of different sizes, and selectively feeds sheets corresponding to the printing size.

Each of the above-mentioned paper feed cassettes is provided with a paper feed path 21 at its sheet feeding end, and feeds a sheet to a register roller 22, and the register roller 22 corrects skew of the sheet front end, and causes the sheet to wait in this position. The printing section 30 is provided on the downstream side of the register roller 22. The printing section 30 is comprised of any of various printing mechanisms such as electrostatic printing, ink-jet printing and silk-screen printing, and the section as shown in the figure adopts the electrostatic printing mechanism. A printing head, development device, transfer charger and cleaning head are provided around an electrostatic drum 31, a latent image is formed on the electrostatic drum with the printing head, the development device adds toner ink to the latent image, the ink is transferred onto the sheet with the transfer charger, and the image is formed. The section as shown in the figure indicates monochrome printing. In the case of color printing, for example, two, first and second, electrostatic drums (or belts) are provided, toner ink formed on the first electrostatic drum is transferred to the second electrostatic drum, this transfer is repeated a plurality of times corresponding to each of color components, Y (Yellow), M (Magenta) and C (Cyan), and the color image is formed on the second electrostatic drum. Next, the color image on the second electrostatic drum is transferred onto the sheet.

The sheet with the toner ink thus transferred thereon is fed to the fusing section 40 and fused. The fusing section 40 is provided with a pair of fusing rollers, and the ink is heated and fused with the pair of fusing rollers. Generally, the fusing rollers apply heat in the range from 150° C. to 100° C., which is dependent on the component of toner ink, to the image on the sheet and coagulates the toner ink. The sheet with the image formed in the fusing section 40 is fed to the sheet discharge section 50. The sheet discharge section 50 is comprised of a sheet discharge path that guides the sheet to a sheet discharge outlet 51, and a sheet discharge roller which is provided in the path and is capable of rotating forward and backward.

Further, when a two-side printing mode is selected in the image forming apparatus, the sheet provided with printing on its one side in the printing section 30 is once fed to a switch-back transport path of the sheet post-processing apparatus, described later, from the sheet discharge outlet 51 with the sheet discharge roller of the sheet discharge section 50, and is switchback-transported via a transport path shown by dotted lines in FIG. 2 by rotating again the sheet discharge roller of the sheet discharge section 50 backward, and the reversed sheet is fed to the printing section 30 via the two-side reversing section 60, is printed on its backside in the printing section 30, and then, is carried out to the sheet post-processing apparatus C.

In addition, an original image formed in an external apparatus such as a computer, or image data transferred from the image reading unit B via a data storage apparatus such as a hard disk or the like is sequentially output to the printing head of the printing section 30. In the printing head, light such as laser light is applied to the electrostatic drum 31 corresponding to the image data, the development device adds toner ink onto the drum, and the image is formed on the sheet with the transfer charger. The sheet with the image thus formed is sequentially carried out of the sheet discharge path of the sheet discharge section 50 to the sheet discharge outlet 51.

[Image Reading Unit Configuration]

The image reading unit B will be described below. This image reading unit B is disposed above the image forming unit A, and is known widely as the so-called scanner that reads an original image of an original document sheet. The configuration is not shown in the figure, and generally, is as described below.

"55" shown in the figure denotes a unit casing, and "56" denotes an original document mount. A platen formed of glass or the like is provided inside the casing 55, and under the platen are provided an optical mechanism including a light-source lamp, image formation lens and the like and photoelectric converter. Then, light of the light-source lamp is applied to the original document on the platen, and the reflected light is applied to the photoelectric converter of a line sensor or the like by an image formation optical mechanism including mirrors, lens and the like for image formation. Meanwhile, above the platen is provided a feeder (automatic document feeding apparatus) that sequentially carries the original document on the original document mount to the platen at a predetermined speed, and the image on the original document fed by the feeder is electrically read by the photoelectric converter.

[Post-processing Unit Configuration]

The post-processing unit C will be described below. As shown in FIGS. 1 to 4, the post-processing unit C is a sheet post-processing apparatus which is coupled to the sheet discharge outlet 51 of the image forming unit A, receives a sheet, which is carried by the forward/backward rotation roller of the sheet discharge section 50 and is discharged from the sheet discharge outlet 51, from a sheet carry-in entrance, and is provided with a post-processing section comprised of at least one of a punching apparatus, stamping apparatus, binding apparatus, bookbinding apparatus, jogger mechanism and the like that performs post-processing on the sheet, and is disposed in the C-shaped storage space formed by the above-mentioned image forming unit A and image reading unit B.

The post-processing unit C is comprised of a first unit D provided with a guide means for guiding the sheet that is sequentially carried in, a second unit E provided with a first post-processing means that performs first post-processing such as punching processing by the punching apparatus and stamping processing by the stamping apparatus, and a third unit F provided with a processing tray to load sheets, which are sequentially carried out through the second unit, in bunch form, a second post-processing means that performs, on the sheets in bunch form placed on the processing tray, second post-processing such as width shift processing (JOG) for shifting the position alternately for each bunch using an alignment means, staple binding processing by the staple apparatus and adhesive binding processing by the bookbinding apparatus, and a collection tray that is disposed on the downstream side of the processing tray and that stores the sheets subjected to the post-processing. Then, the first, second and third units are successively provided parallel along the sheet carrying-out direction with respect to a board frame C1 forming the apparatus body of the post-processing unit C. In addition, the first, second and third units may be successively provided parallel along the sheet carrying-out direction with respect to a board frame of the image forming unit A or image reading unit B.

Then, the first unit D is fixed and supported to/by the board frame C1. Meanwhile, the second unit E and third unit F are coupled to the first unit D by a first coupling means H, and are supported to be movable by a pair of front and back guide rails L disposed on the front side and back side of the board frame C1 so as to enable the units E and F to be pulled out in the sheet carrying-out direction for separating from the first unit D by release of the first coupling means H. Further, the second unit E is coupled to the third unit F by a second coupling means G, and is configured to be able to separate from the third unit F by release of the second coupling means G.

[Guide Rails]

In addition, the structure of a pair of guide rails L is used generally as a pull-out mechanism of furniture, particularly, steel disk, document storage cabinet and the like, in which one guide rail is fixed to the board frame C1, and the other one is slidable with respect to the guide rail, and in this Embodiment, is comprised of the guide rail fixed to the third unit.

[First Coupling Means]

Figure 8:
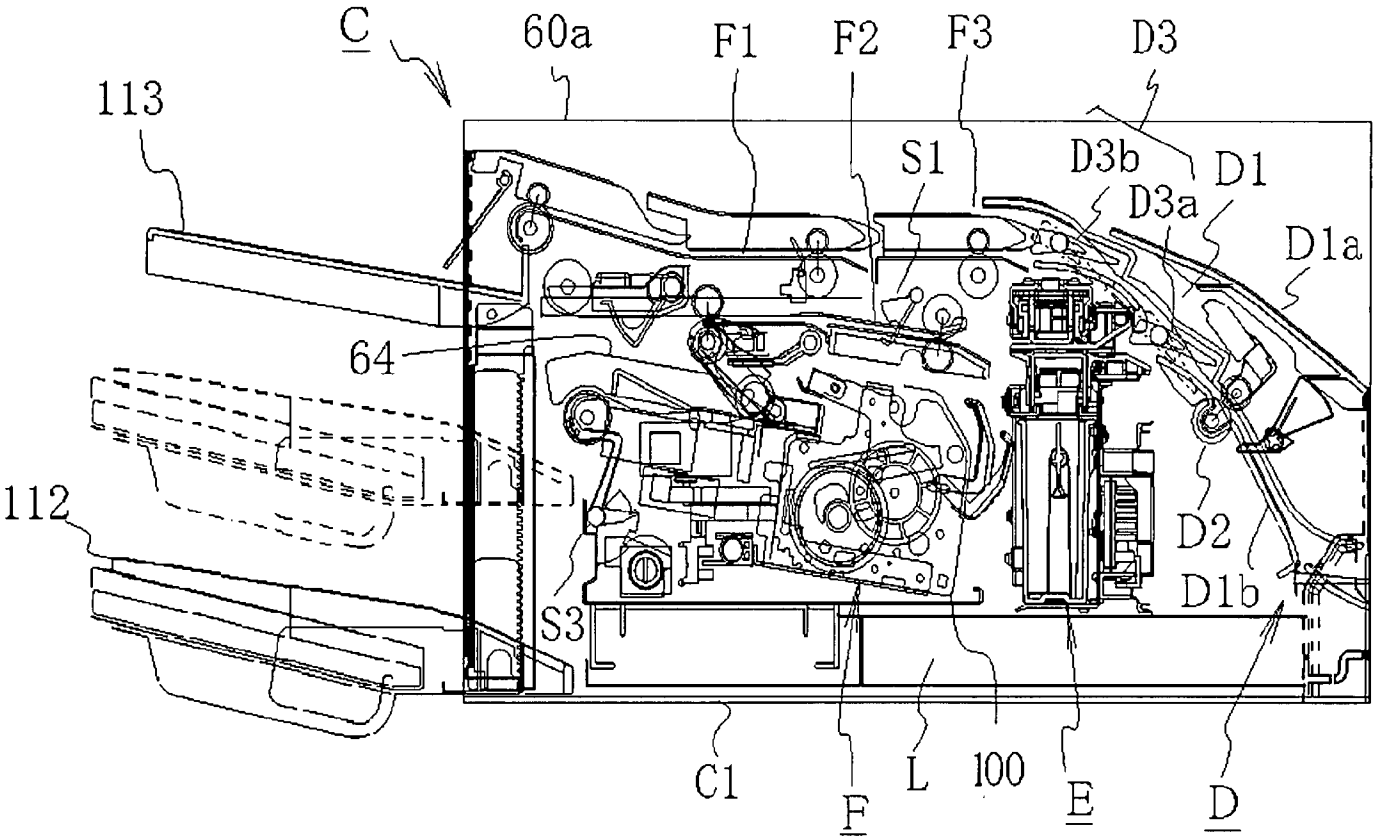
FIG. 8 is an enlarged view of the sheet post-processing apparatus of FIG. 2.
Figure 21:
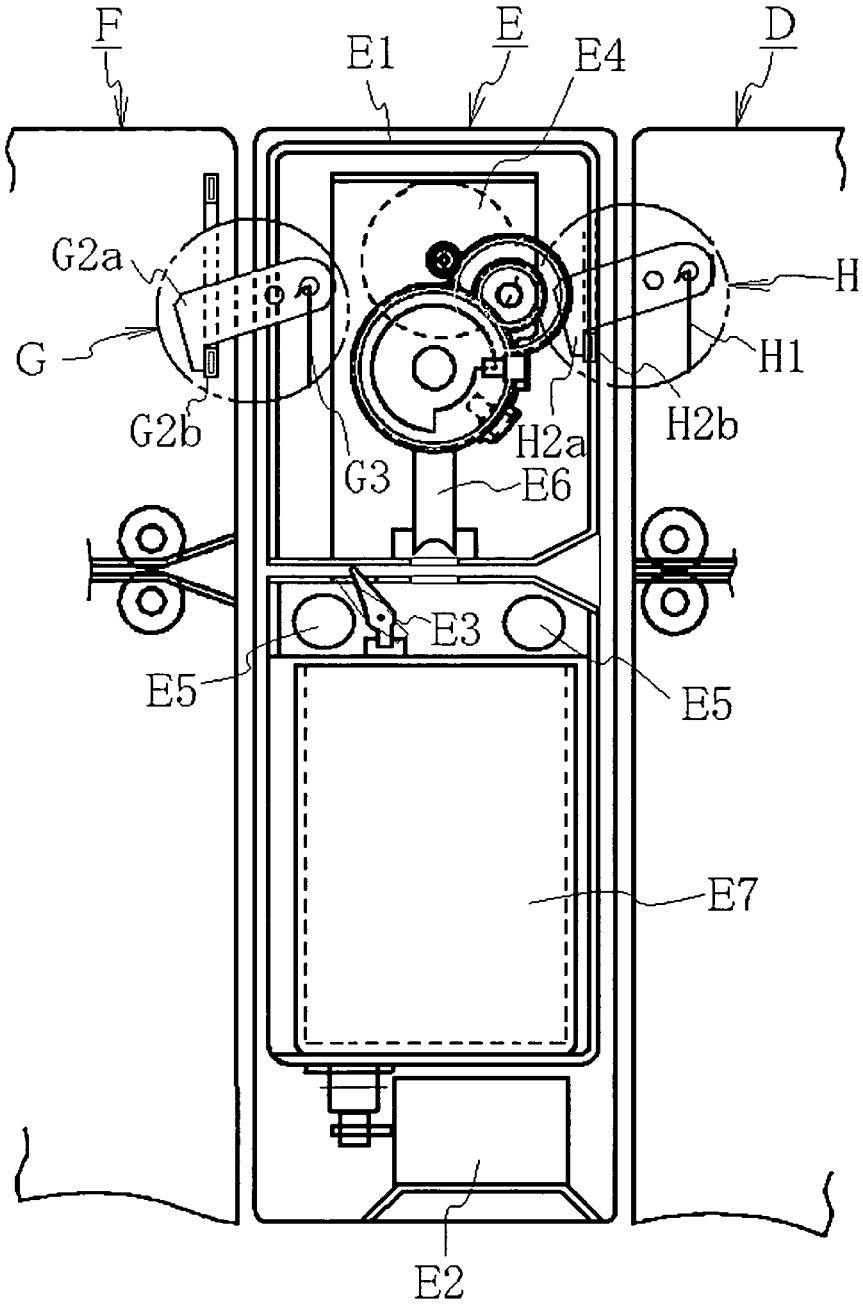
FIG. 21 is a side sectional view of FIG. 20.

As shown in FIG. 21, the first coupling means H is comprised of a guide plate open/close lever H1, lock hook H2*a* and lock bracket H2*b*. Further, the guide plate open/close lever H1 is coupled in mechanism to move up and down in conjunction with operation of a first operating lever D4 (see FIG. 5) provided with the function as a shift inhibiting means D5 provided in the first unit D, described later, and cause the hook of the lock hook H2*a* to swing between a lock position for locking in the lock bracket H2 and a release position for releasing the lock, while causing a lower guide plate D1*b* of a guide means D1 constituting the first unit D as shown in FIG. 8 to swing up and down. In addition, in FIG. 21, the guide plate open/close lever H1, lock hook H2*a*, and first operating lever D4 are disposed on the first unit D side, while the lock bracket H2*b* is disposed on the second unit E side, and the guide plate open/close lever H1, lock hook H2*a*, and first operating lever D4 may be disposed on the second unit E side, while the lock bracket H2*b* may be disposed on the first unit D side. Further, the structure is to couple the second unit E to the third unit F by the second coupling means G, and therefore, the lock hook H2*a* and lock bracket H2*b* may be disposed in between the first unit D and the third unit F, instead of being disposed in between the first unit D and the second unit E.

[Second Coupling Means]

Figure 20:
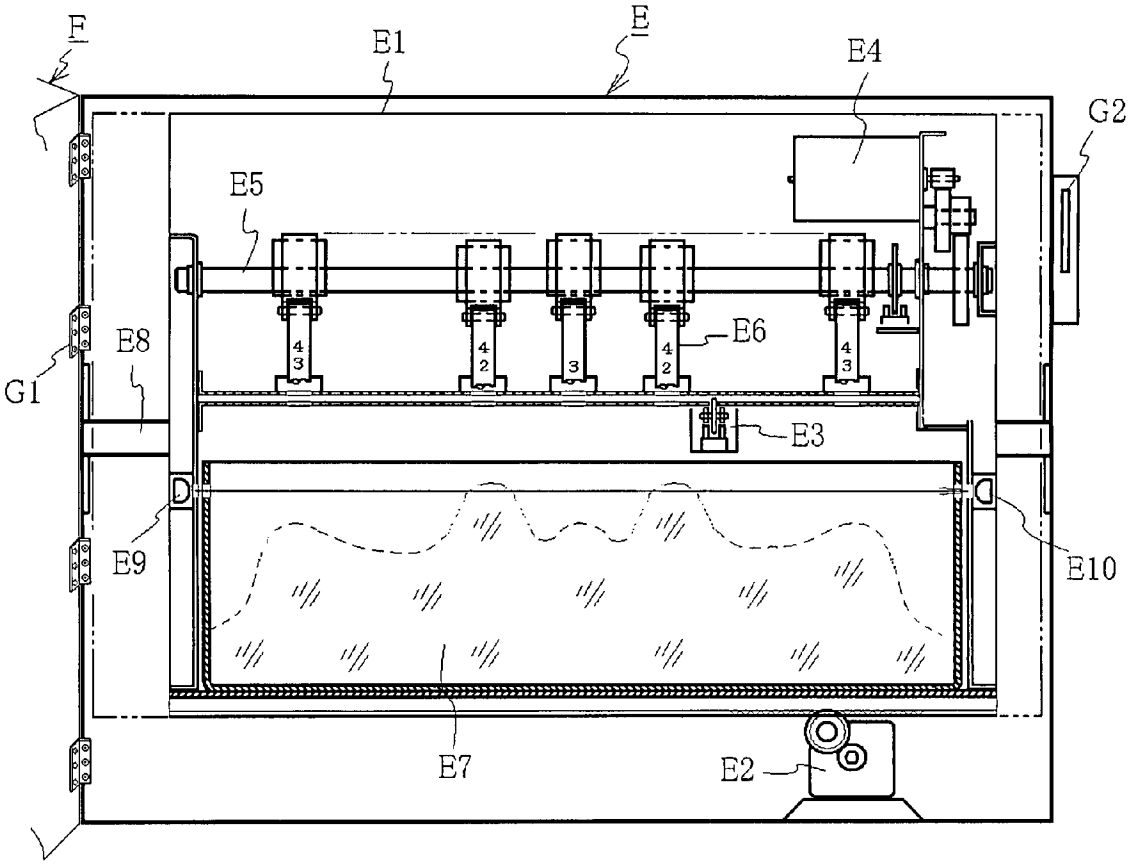
FIG. 20 is a plan sectional view to explain an inner configuration of a second unit in the sheet post-processing apparatus of FIG. 9.

In the second coupling means G, in the case where the front of the second unit E is opened widely with respect to the third unit F, the second unit E and the third unit F are mutually supported swingably on their rear side by a hinge means comprised of a hinge G1, the same functional member as the hinge or the like as shown in FIGS. 6 and 20, while being supported on their front side by a lock mechanism comprised of a lock hook G2*a* and lock bracket G2*b* to enable the units E and F to be coupled and released as shown in FIG. 21, and one of the second unit E and the third unit F is provided, with a second operating lever G3 provided with the function as a release means for releasing coupling of the lock mechanism. Then, the second operating lever G3 on the front side is operated by manual operation to release coupling between the second unit E and the third unit F by the lock hook G2*a*, and the front side (see FIG. 6) of the second unit E is thereby capable of shifting to the first unit side with respect to the third unit F. In addition, the lock hook G2*a* and lock bracket G2*b* are respectively disposed on the second unit E side and the third unit F side, and the lock hook G2*a* and lock bracket G2*b* may be respectively disposed on the third unit F side and the second unit E side.

[Shift Inhibiting Means]

The first operating lever D4 is not only operated in conjunction with the guide plate open/close lever H1 (see FIG. 21) for releasing the first coupling means H as described previously, but also serves the function as a shift inhibiting means which reserves clearance opened widely between the first unit D and the second unit E located in the pull-out position when the second unit E and the third unit F coupled to each other by the second coupling means G are pulled out in the sheet carrying-out direction with respect to the first unit D by releasing the first coupling means H, and are located in the pull-out positions, while inhibiting the second unit E, as a prop as shown in the figure, so that the second unit E does not shift to the first unit D side even when the second coupling means G is released accidentally in the case where a sheet remains in the first unit D and the lower guide plate D1*b* of the guide means D1 is opened by the guide plate open/close lever H1 to remove the remaining sheet. In addition, in this Embodiment, the first operating lever D4 is shared as the shift inhibiting means D5 as a prop. Alternately, the shift inhibiting means D5 may be comprised of a different member that is driven and coupled to the first operating lever D4, and may be another member other than the prop as long as the member is capable of inhibiting at least so that the pulled-out second unit E does not shift to the first unit D side.

Actually, the second unit E and the third unit F are pulled out in the sheet carrying-out direction by releasing the first coupling means H, and are held in the pull-out positions by the first operating lever D4 (shift inhibiting means D5), and after releasing inhibition by the first operating lever D4, the front side of the second unit E released by the second coupling means G is capable of shifting to the first unit D side.

Figure 5:
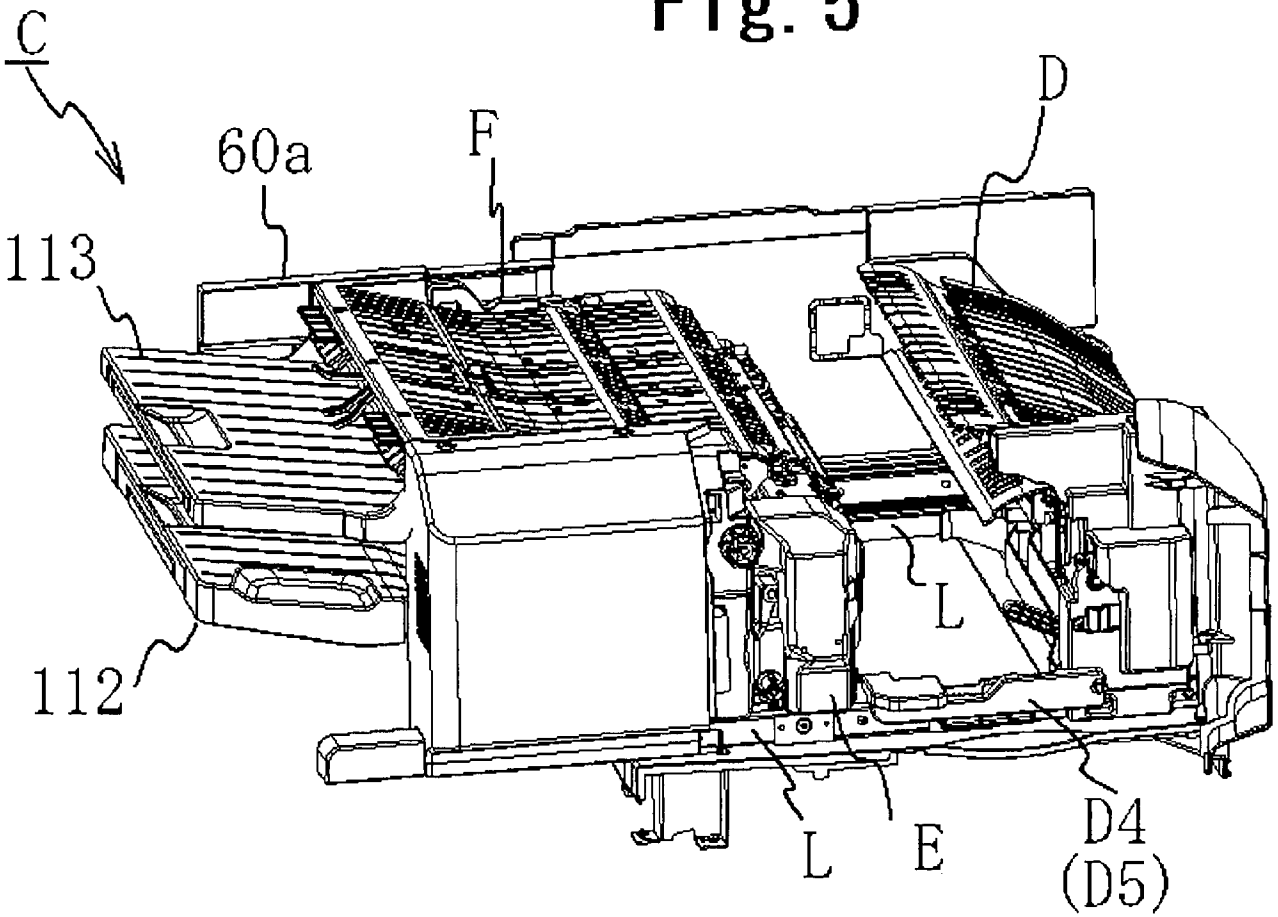
FIG. 5 is an appearance perspective view showing a first state of the sheet post-processing apparatus according to the invention.
Figure 6A:
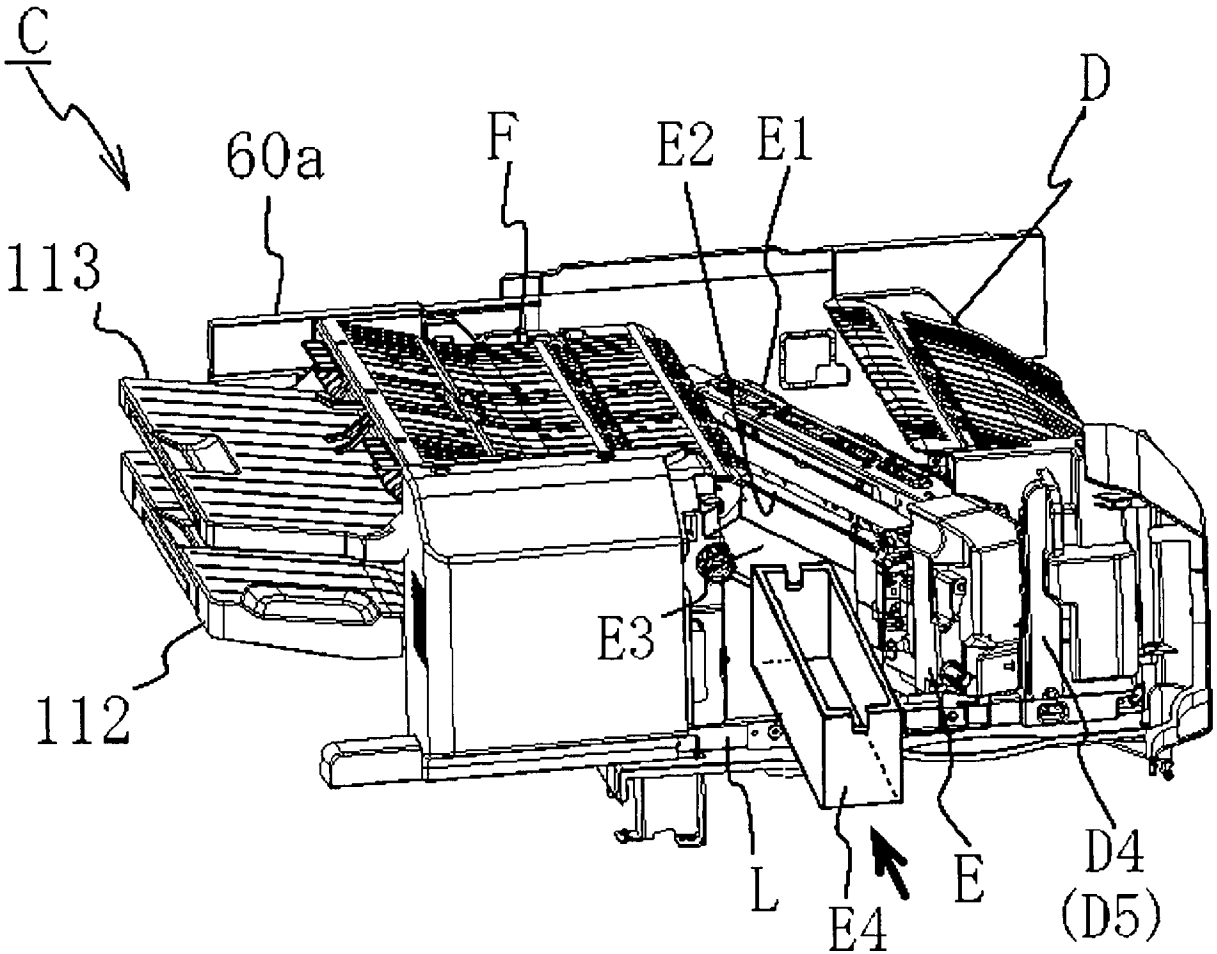
FIG. 6A is an appearance perspective view showing a second state of the sheet post-processing apparatus according to the invention.
Figure 6B:
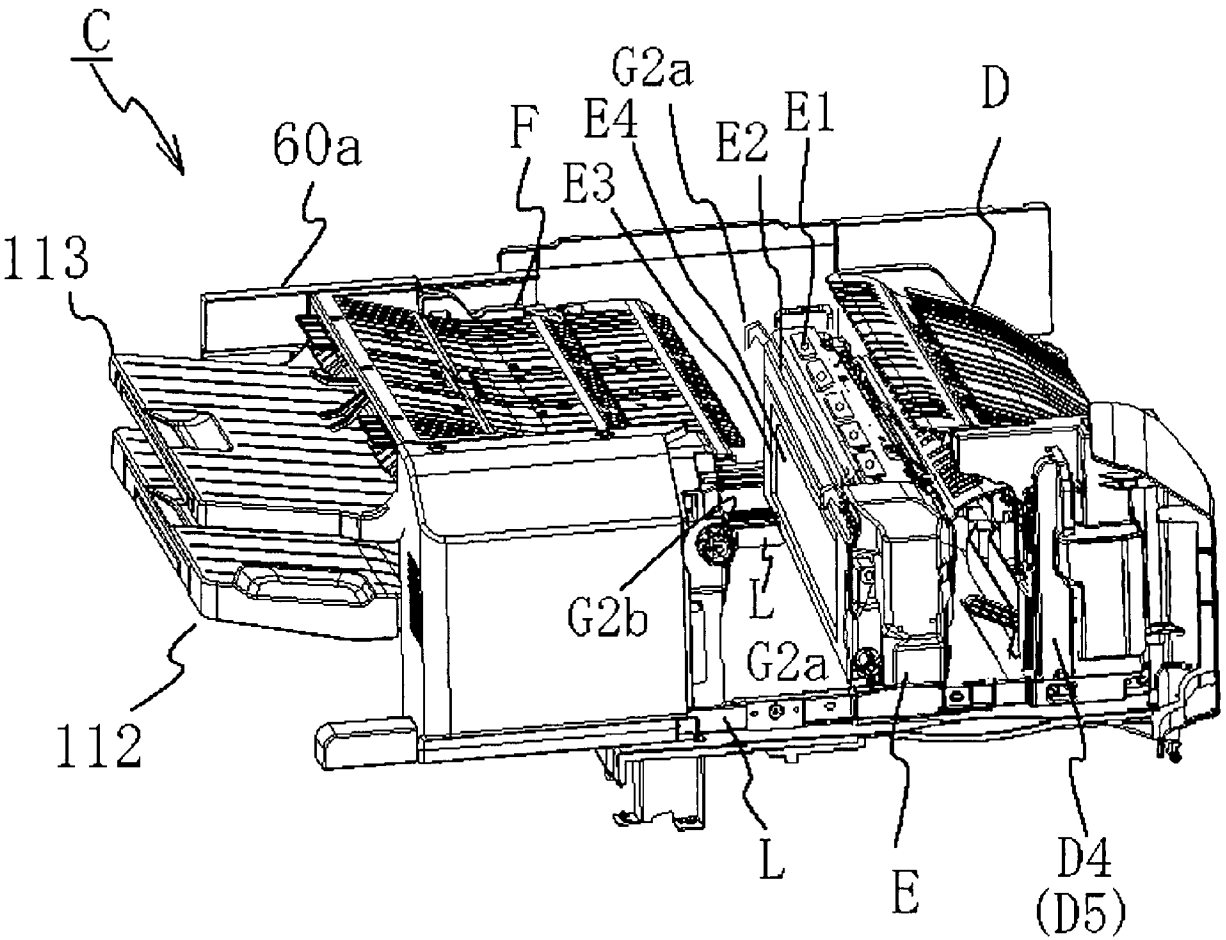
FIG. 6B is an appearance perspective view of another Embodiment showing the second state of the sheet post-processing apparatus according to the invention.
Figure 7:
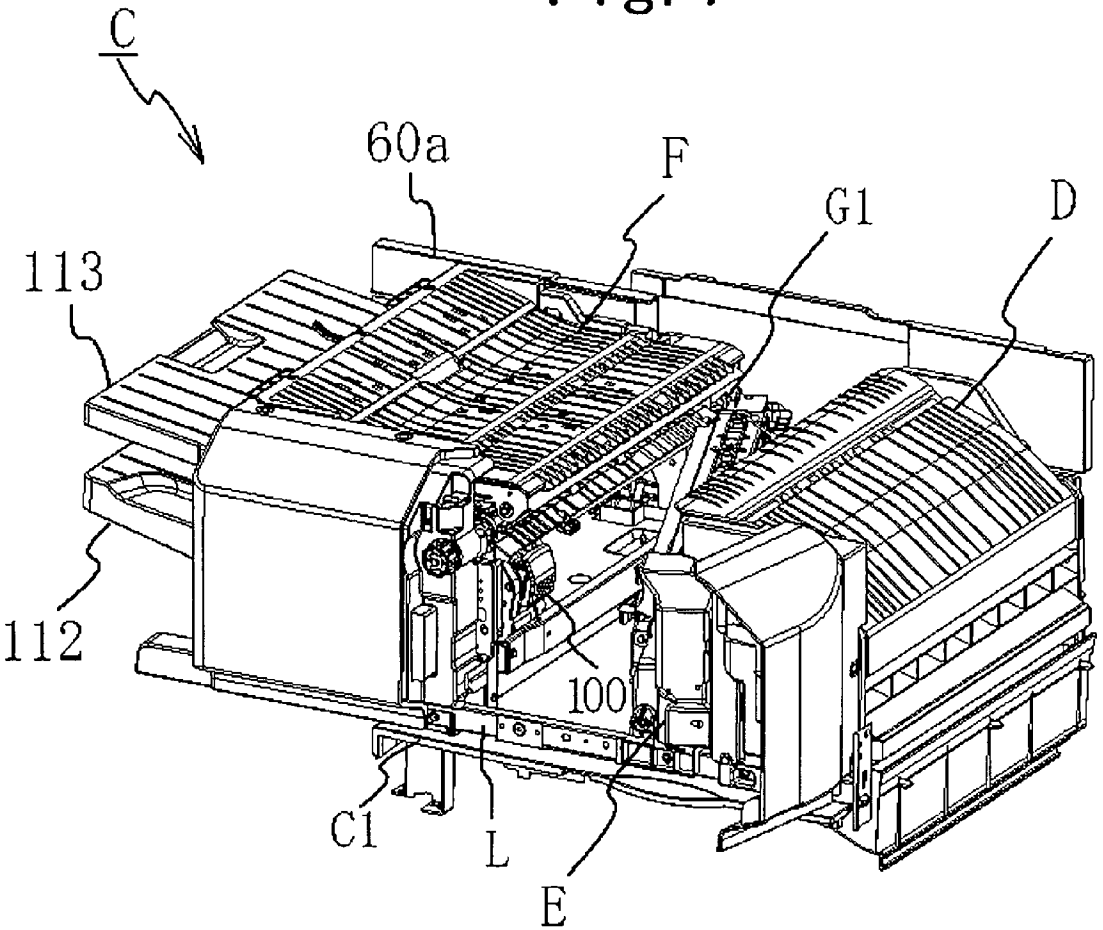
FIG. 7 is an appearance perspective view in which the state of FIG. 6 is viewed in a different direction.
Figure 9:
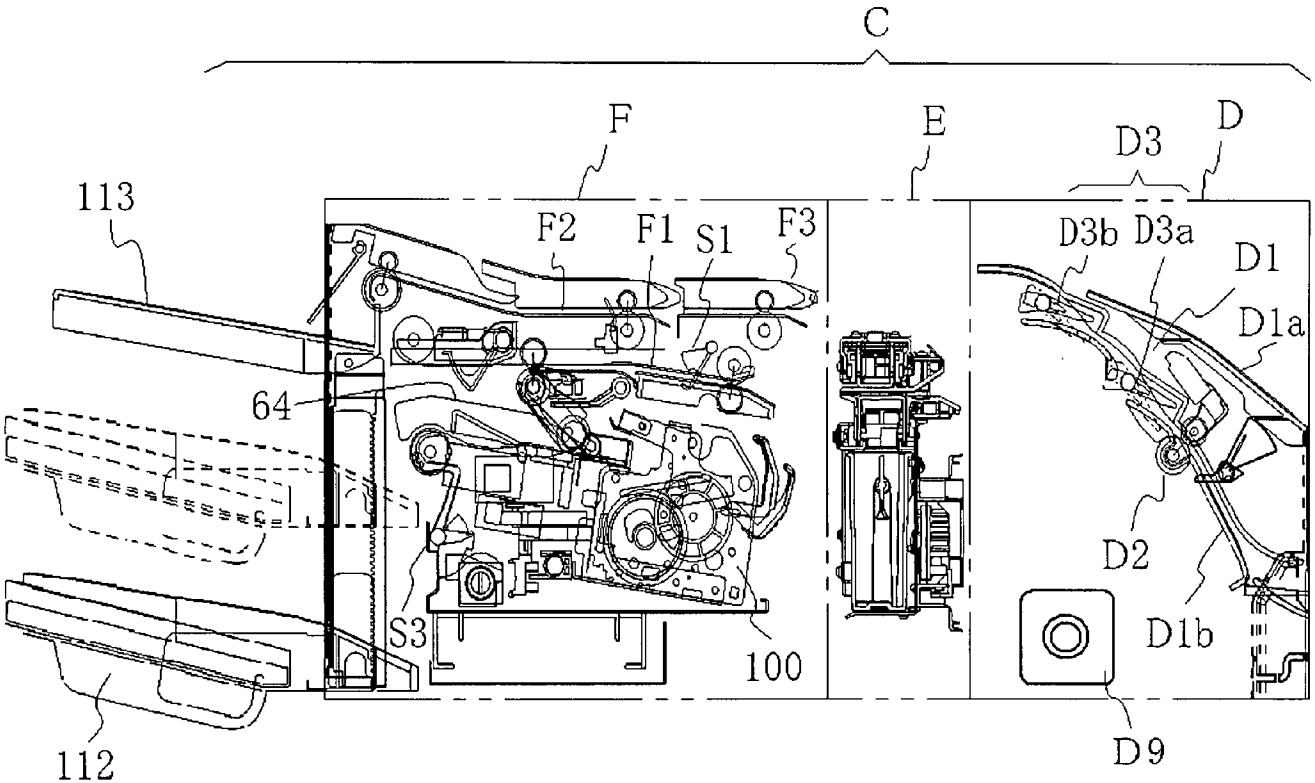
FIG. 9 is a simplified exploded view to explain a configuration of each unit of the sheet post-processing apparatus of FIG. 8.

The post-processing unit C will specifically be described below based on FIGS. 5 to 9. FIG. 5 is an appearance perspective view of the sheet post-processing apparatus shown in FIGS. 3 and 4 in a first state. FIG. 6A is an appearance perspective view showing a second state of the sheet post-processing apparatus according to the invention. FIG. 6B is an appearance perspective view of another Embodiment showing the second state of the sheet post-processing apparatus according to the invention. FIG. 7 is an appearance perspective view in which the state of FIG. 6 is viewed in a different direction. Further, FIG. 8 is an enlarged view of the sheet post-processing apparatus of FIG. 2. FIG. 9 is a simplified exploded view to explain a configuration of each unit of the sheet post-processing apparatus of FIG. 8.

[Configuration of the First Unit]

Based on FIG. 9, described first is the first unit D provided with the guide means for guiding a sheet which is carried in sequentially from the image forming unit A so as to carry out the sheet to the third unit F through the second unit E. The guide means is provided with the following configuration.

First, a pair of guide plates D1 (D1*a*, D1*b*) disposed vertically while being spaced a certain distance away from each other. Further, a pair of transport rollers D2 which are disposed (in the figure, one location) in the sheet carrying-out direction at an interval of the minimum sheet width carried out from between the pair of guide plates D1, where one of the rollers and the other one are axially supported rotatably by the upper guide plate D1*a* and the lower guide plate D1*b*, respectively. Furthermore, the allocating means D3 comprised of an allocating means D3*a* for guiding the sheet to either a first transport path F1 to discharge the received sheet to a collection tray 112, described later, of the third unit F via the second unit E so as to perform the post-processing of the second unit E and the third unit F on the sheet, or a second transport path F2 to discharge the received sheet directly to a storage tray 113, described later, without performing the post-processing of the second unit E and the third unit F, and an allocating means D3*b* for receiving a rear end of two-side printing sheet with printing applied to one side, and guiding the sheet to either a third transport path F3 that is used to send the sheet back to the two-side reversing section 60 (duplex) of the image forming unit A or the above-mentioned second transport path F2. Still furthermore, the guide plate open/close lever H1 (see FIG. 21) which pushes the lower guide plate D2*b* upward to a position in which the transport roller pair D2 presses against each other when the lever H1 is in a guide position, while in a release position, causing the lower guide plate D1*b* to move away from the upper guide plate D1*a* to separate the transport roller pair D2 from each other, and releasing the nip of the sheet remaining inside the transport path to enable the sheet to be removed. Moreover, as shown in FIGS. 5 and 6, in the vicinity of the lower guide plate D1*b*, the first operating lever D4 (shift inhibiting means D5) which is rotatable by mutual operation between the release position in which the lever is in a stand state and the inhibition position in which the lever is tilted in a horizontal state almost perpendicular to the stand state, functions as the shift inhibiting means in the inhibition position for inhibiting the shift of the second unit E and the third unit F, which are pulled out of the first unit D and located in the pull-out positions, from the pull-out positions, and almost concurrently with the inhibition, operates the guide plate open/close lever H1 that is coupled and driven to enable the lower guide plate D1*b* to be released. Further, a stepping motor D9 capable of rotating forward and backward, in the side wall guide plate on the front or back side of the unit, which always controls rotation of the pair of transport rollers D2, while also performing control for switching the direction by forward rotation and backward rotation via clutches provided in the allocating means D3. The guide means is provided with at least the aforementioned configuration.

Figure 17A:
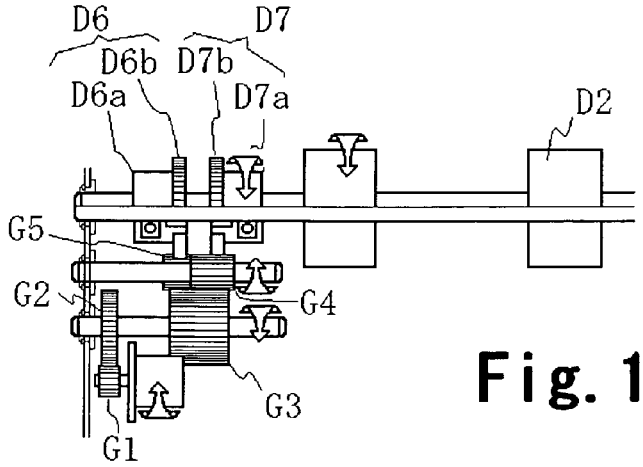
FIGS. 17A to 17D are explanatory views to explain a rotation driving system of transport rollers of the first unit in the sheet post-processing apparatus of FIG. 10.
Figure 17B:
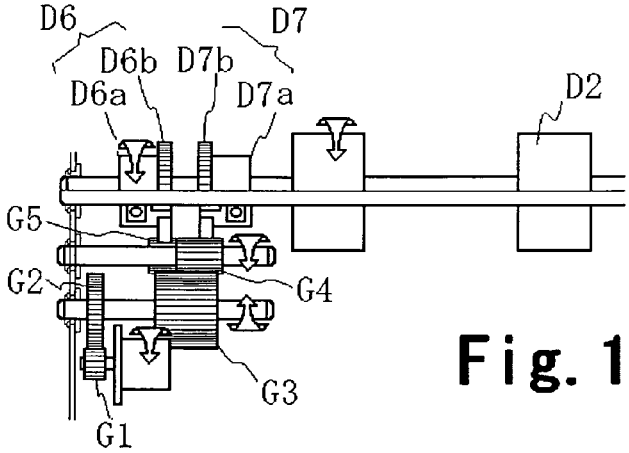
Figure 17C:
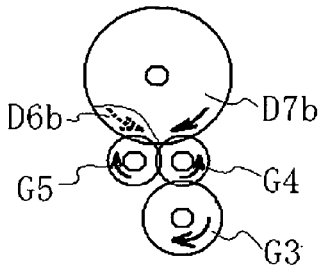
Figure 17D:
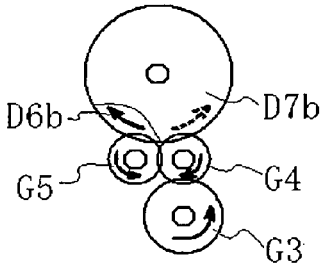

In addition, as shown in FIGS. 17A to 17D, the rotary shaft D2*a* of the transport roller D2 is provided with a rotation direction converting means D8 to rotate the transport roller D2 in the sheet transport direction in either direction of forward and backward of the stepping motor D9. The rotation direction converting means D8 is comprised of a pair of one-way clutches D6, D7 capable of being driven and rotated in opposite directions. The one-way clutches D6, D7 are comprised of one-way clutch bodies D6*a*, D7*a* and gears D6*b* and D7*b*. Further, the gears D6*b*, D7*b* respectively mesh with gears G5, G4, the gears G4, G5 mesh in the center portion, and the gear G4 is coupled to the stepping motor D9 to be driven via gears G3, G2, G1. Then, by thus configuring the rotation direction converting means D8, when the stepping motor D9 rotates in the direction of the arrow (forward rotation) as shown in FIG. 17A, as shown in FIG. 17C, the gear D6*b* of the one-way clutch D6 idles in the arrow direction shown by the dotted lines, the gear D7*b* of the one-way clutch D7 is driven to rotate in the arrow direction shown by the solid line, and the transport roller D2 is thereby rotated in the sheet transport direction. Meanwhile, when the stepping motor D9 rotates in the direction of the arrow (backward rotation) as shown in FIG. 17B, as shown in FIG. 17D, the gear D7*b* of the one-way clutch D7 idles in the arrow direction shown by the dotted lines, the gear D6*b* of the one-way clutch D6 is driven to rotate in the arrow direction shown by the solid line, and it is thereby possible to rotate the transport roller D2 in the sheet transport direction.

Figure 10:
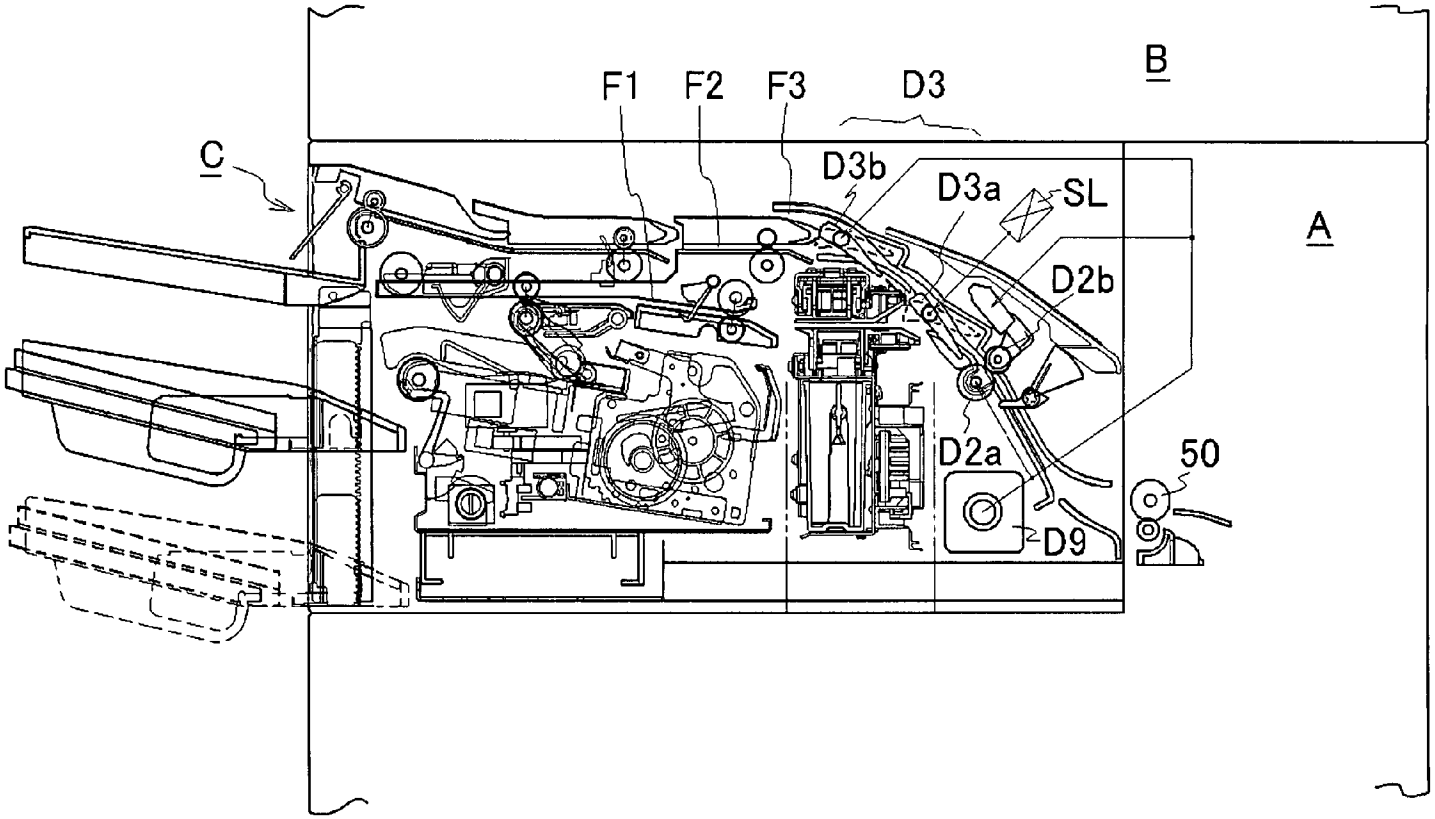
FIG. 10 is a plan sectional view to explain a driving coupling system of a first unit in the sheet post-processing apparatus of FIG. 8.

The operation of the first unit will specifically be described based on FIGS. 10 to 16. First, FIG. 10 shows a driving system by the stepping motor D9. The stepping motor D9 is driven and coupled to be able to control so that the driving roller D2*a* of the pair of transport roller D2 rotates in the sheet transport direction by the rotation direction converting means D8 in forward and backward rotation, and that in backward rotation, the driven roller D2*b* separates from the driving roller D2*a*, while the allocating means D3*b* is switched to guide the front end of the sheet fed by the sheet discharge roller of the sheet discharge section 50 of the image forming unit A to the switchback transport path. In addition, the allocating means D3*a* is controlled to be able to switch in forward rotation of the stepping motor D9 by an electromagnetic solenoid SL, while being controlled to open the switchback transport path forcibly by the stepping motor D9 in backward rotation, and is configured so that the switchback transport path is reliably opened in backward rotation of the stepping motor D9.

Figure 11:
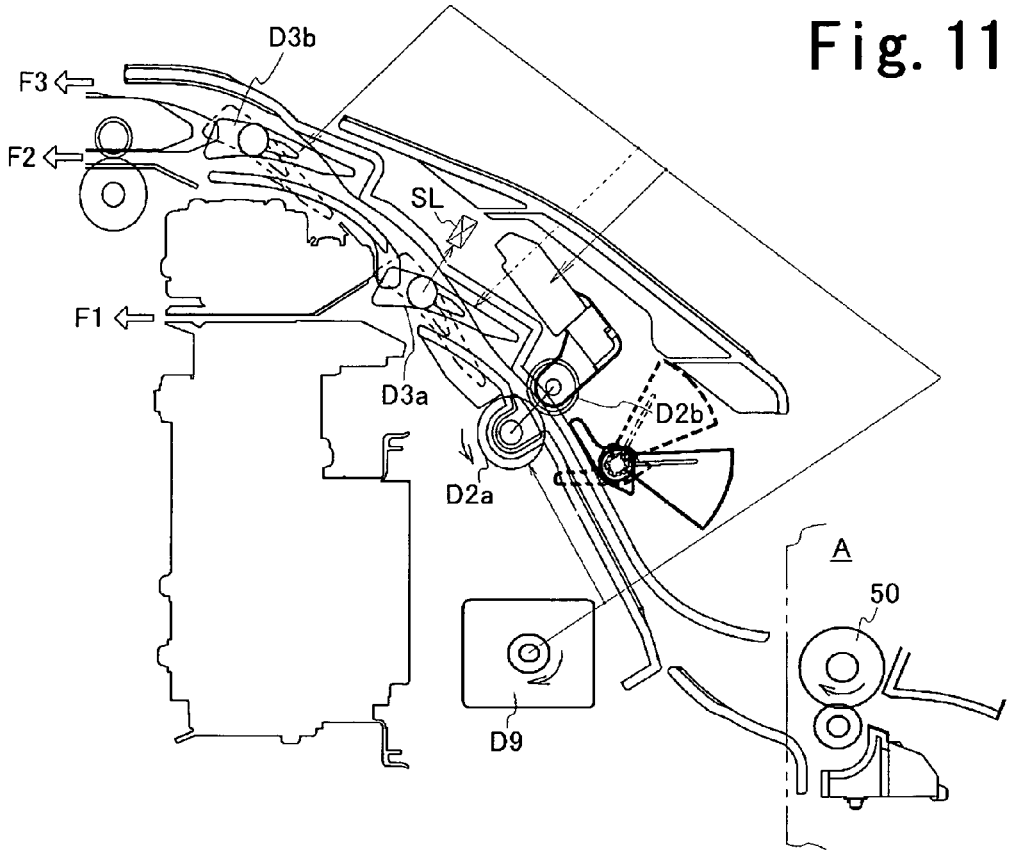
FIG. 11 is a first operation explanatory view of the first unit in the sheet post-processing apparatus of FIG. 9.

The operation will be described below. First, the state as shown in FIG. 11 shows the transport system for feeding the sheet carried out of the sheet forming unit A to the first transport path F1 to apply post-processing to the sheet, a signal such that the post-processing mode is selected is beforehand received from the image forming unit A, the electromagnetic solenoid SL is turned on to cause the allocating means D3*a* to be in the state shown by the solid line, the stepping motor D9 is rotated forward to press the driven roller D2*b* against the driving roller D2*a*, the driving roller D2*a* is rotated in the sheet transport direction, and it is thereby possible to feed the sheet, which is sequentially carried out of the sheet discharge roller of the sheet discharge section 50 of the image forming unit A, to the first transport path F1. In addition, the allocating means D3*b* waits in the state shown by the solid line by forward rotation of the stepping motor D9.

Figure 12:
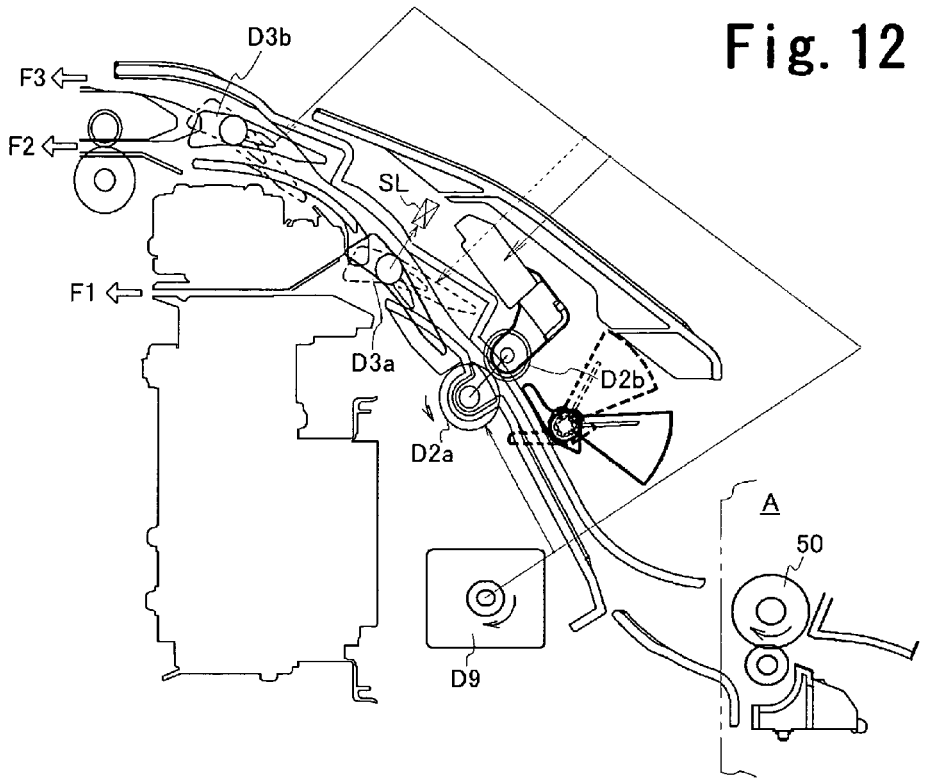
FIG. 12 is a second operation explanatory view of the first unit in the sheet post-processing apparatus of FIG. 9.

Next, the state as shown in FIG. 12 shows the transport system for feeding the sheet carried out of the sheet forming unit A to the second transport path F2 for discharging the sheet directly to the storage tray 113 without applying post-processing to the sheet, a signal such that the non-post-processing mode is selected is beforehand received from the image forming unit A, the electromagnetic solenoid SL is turned off to cause the allocating means D3*a* to be in the state shown by the solid line, the stepping motor D9 is rotated forward to press the driven roller D2*b* against the driving roller D2*a*, the driving roller D2*a* is rotated in the sheet transport direction, while at the same time, the allocating means D3*b* is held at the state shown by the solid line, and the sheet, which is sequentially carried out of the sheet discharge roller of the sheet discharge section 50 of the image forming unit A, is fed to the second transport path F2.

Figure 13:
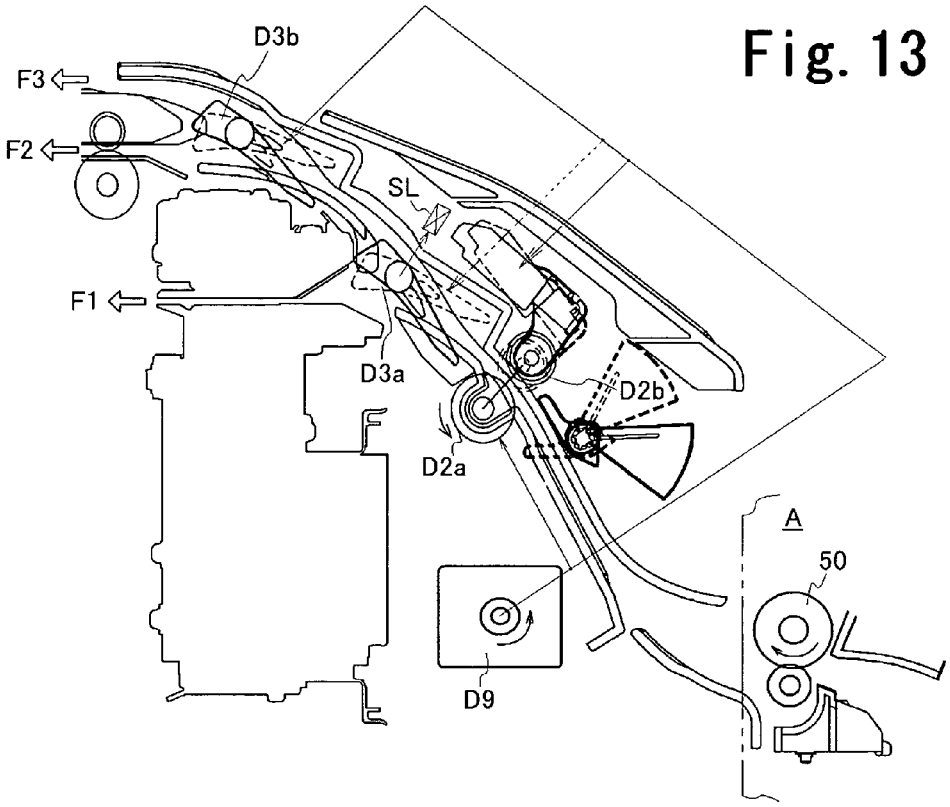
FIG. 13 is a third operation explanatory view of the first unit in the sheet post-processing apparatus of FIG. 9.

Next, the state as shown in FIG. 13 shows the transport system for feeding the sheet with printing applied to one side to the third transport path F3 used in switching the sheet back and reversing so that the image forming unit A prints on both sides, a signal such that the two-side printing mode is selected is beforehand received from the image forming unit A, the electromagnetic solenoid SL is turned off to cause the allocating means D3*a* to be in the state shown by the solid line, the stepping motor D9 is rotated backward to keep the driven roller D2*b* separate from the driving roller D2*a*, the driving roller D2*a* is rotated in the sheet transport direction, while at the same time, the allocating means D3*b* is held at the state shown by the solid line, and the front end of the sheet, which is sequentially carried out of the sheet discharge roller of the sheet discharge section 50 of the image forming unit A, is fed to the third transport path F3 by the sheet discharge roller of the sheet discharge section 50. At this point, the reason why the driving roller D2*a* separated from the driven roller D2*b* is rotated in the sheet transport direction is to smoothly guide the front end of the sheet fed by the sheet discharge roller of the sheet discharge section 50 to the third transport path F3 and thereby prevent the sheet from jamming or buckling.

Figure 14:
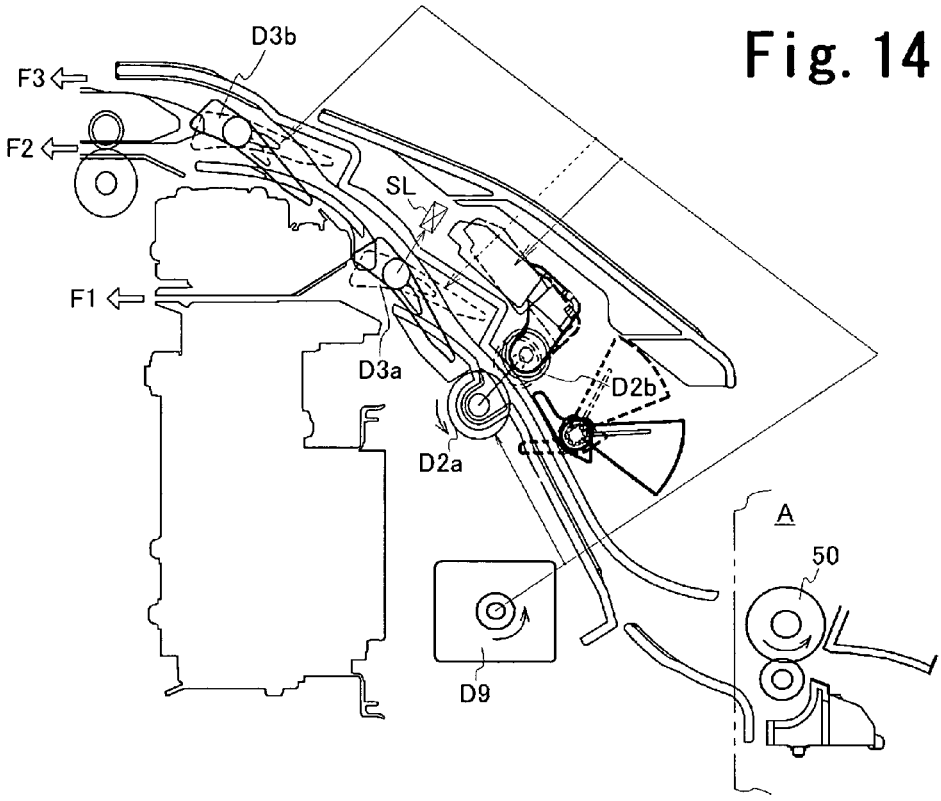
FIG. 14 is a fourth operation explanatory view of the first unit in the sheet post-processing apparatus of FIG. 9.

Further, the state as shown in FIG. 14 shows the state in which the sheet, which is fed to the third transport path F3 by the sheet discharge roller of the sheet discharge section 50 of the image forming unit A, is switched back by backward rotation of the sheet discharge roller of the sheet discharge section 50 by control of the image forming unit A, and during the period, until the sheet post-processing apparatus C receives a two-side printing finish signal from the image forming unit A, the stepping motor D9 is rotated backward to keep the third transport path F3 as shown in FIGS. 13 and 14 open.

Figure 15:
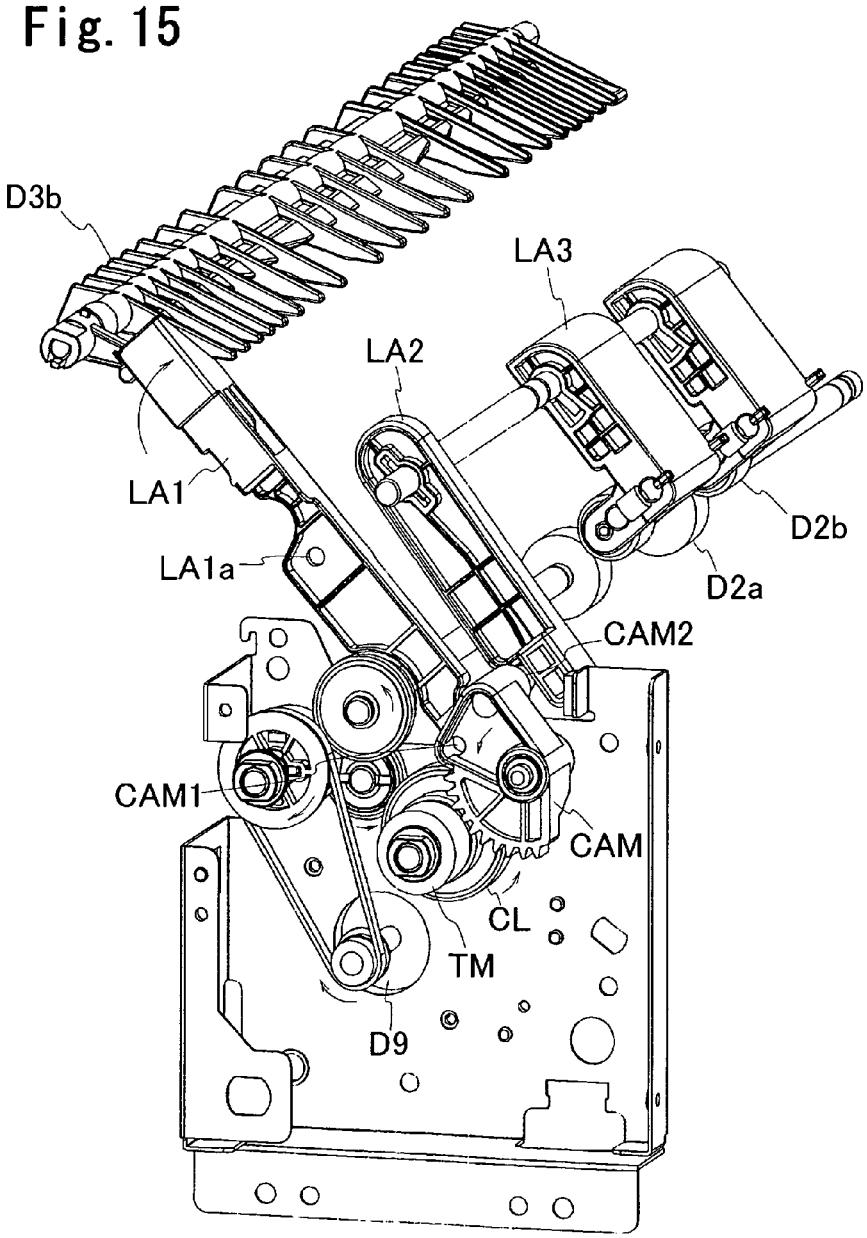
FIG. 15 is a first state perspective view to explain the driving coupling system of the first unit in the sheet post-processing apparatus of FIG. 10.
Figure 16:
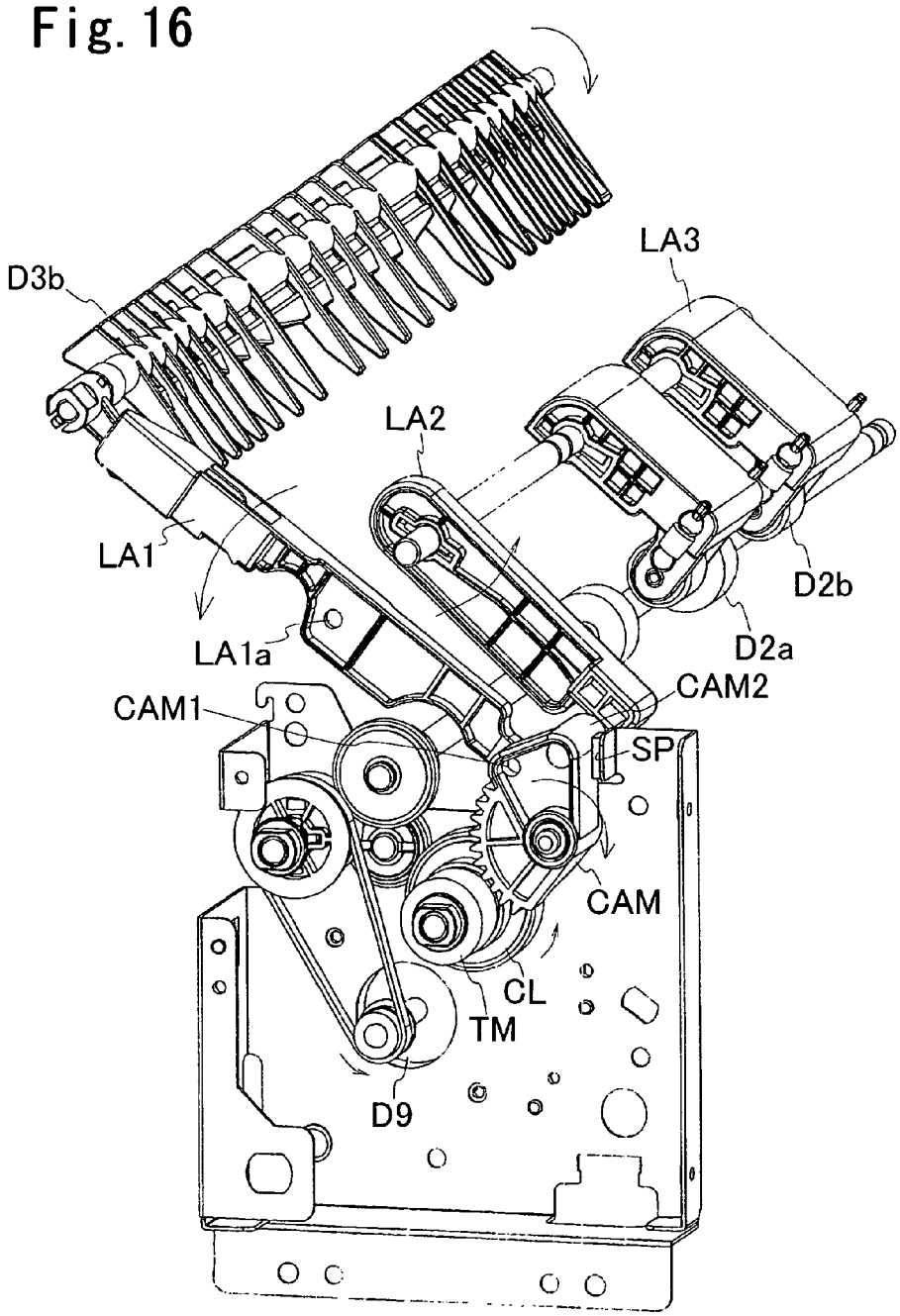
FIG. 16 is a second state perspective view to explain the driving coupling system of the first unit in the sheet post-processing apparatus of FIG. 10.

FIGS. 15 and 16 are state perspective views to explain the driving coupling system of the first unit which is switched in driving by forward and backward rotation of the stepping motor D9 in response to each transport system as described above, FIG. 15 shows a state diagram in forward rotation of the stepping motor D9, and FIG. 16 shows a state diagram in backward rotation of the stepping motor D9. In FIG. 15, a cam (CAM) rotates in a counterclockwise direction as shown by the arrow by a torque limiter TM and one-way clutch CL undergoing driving rotation via a transmission gear line by forward rotation shown by the arrow of the stepping motor D9. Then, when the CAM rotates a predetermined angle in a counterclockwise direction, rotation is inhibited by a stopper, not shown, subsequent rotation force by forward rotation shown by the arrow of the stepping motor D9 is absorbed by the torque limier TM and one-way clutch CL, and the CAM is held at the stopper rest position. By rotation of the CAM, a flapper lever LA1, which is pin-slit-coupled at one end to a first cam pin CAM1 embedded in the CAM and switches the swing of the allocating means D3*b*, is swung around the rotation supporting point LA1*a* in a clockwise direction shown by the arrow, and by the other end of the flapper lever LA1 bouncing above the plane of paper, the allocating means D3*b* swings to the solid-line position shown in FIG. 12 and is kept by a spring biasing means, not shown, provided in the rotation support shaft of the allocating means D3*b*. Meanwhile, by a second cam pin CAM 2 of the CAM rotating in a counterclockwise direction shown by the arrow, a driven roller separating lever LA2 brought into contact with the second cam pin CAM 2 is biased in the same-axis rotation direction as a driven roller support lever LA3 that is swung and biased in a clockwise direction shown by the arrow by the spring biasing means for biasing below the plane of paper to press the driven roller D2*b* against the driving roller D2*a*, and is configured to follow the second cam pin CAM 2.

In FIG. 16, the CAM rotates in a clockwise direction shown by the arrow by the torque limiter TM and one-way clutch CL undergoing driving rotation via the transmission gear line by backward rotation shown by the arrow of the stepping motor D9. Then, when the CAM rotates a predetermined angle in a clockwise direction, rotation is inhibited by the stopper SP, subsequent rotation force by backward rotation shown by the arrow of the stepping motor D9 is absorbed by the torque limier TM and one-way clutch CL, and the CAM is held at the rest position by the stopper SP. By rotation of the CAM, the flapper lever LA1, which is pin-slit-coupled at one end to the first cam pin CAM1 embedded in the CAM and switches the swing of the allocating means D3*b*, swings around the rotation support point LA1*a* in a counterclockwise direction shown by the arrow, the other end of the flapper lever LA1 is displaced below the plane of paper, and the allocating means D3*b* swings to the solid-line position shown in FIG. 13 and is kept against the spring force of the spring biasing means, not shown, provided in the rotation support shaft of the allocating means D3*b*. Meanwhile, by the second cam pin CAM 2 of the CAM rotating in a clockwise direction shown by the arrow, the driven roller separating lever LA2 brought into contact with the second cam pin CAM 2 is swung in a counterclockwise direction shown by the arrow by the second cam pin CAM 2 against the biasing force for biasing in the same-axis rotation direction as the driven roller support lever LA3 that is swung and biased in a clockwise direction shown by the arrow by the spring biasing means for biasing below the plane of paper to press the driven roller D2*b* against the driving roller D2*a*, and by the swing of the driven roller separating lever LA2 in a counterclockwise direction shown by the arrow, the driven roller D2*b* is held at the position separate from the driving roller D2*a*.

Figure 18:
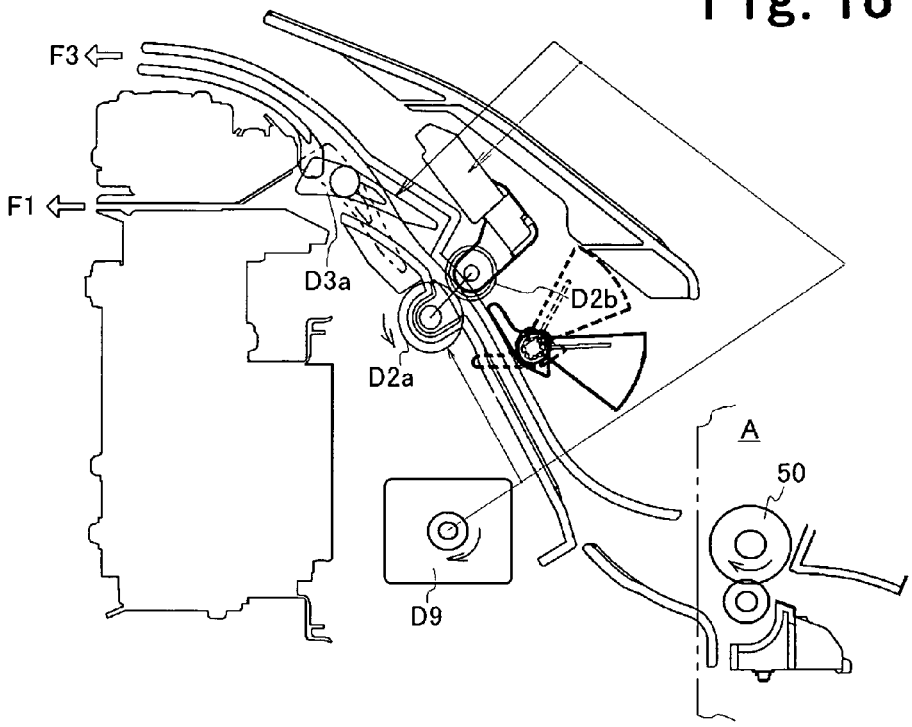
FIG. 18 is a first operation explanatory view to explain another Embodiment of the first unit in the sheet post-processing apparatus.
Figure 19:
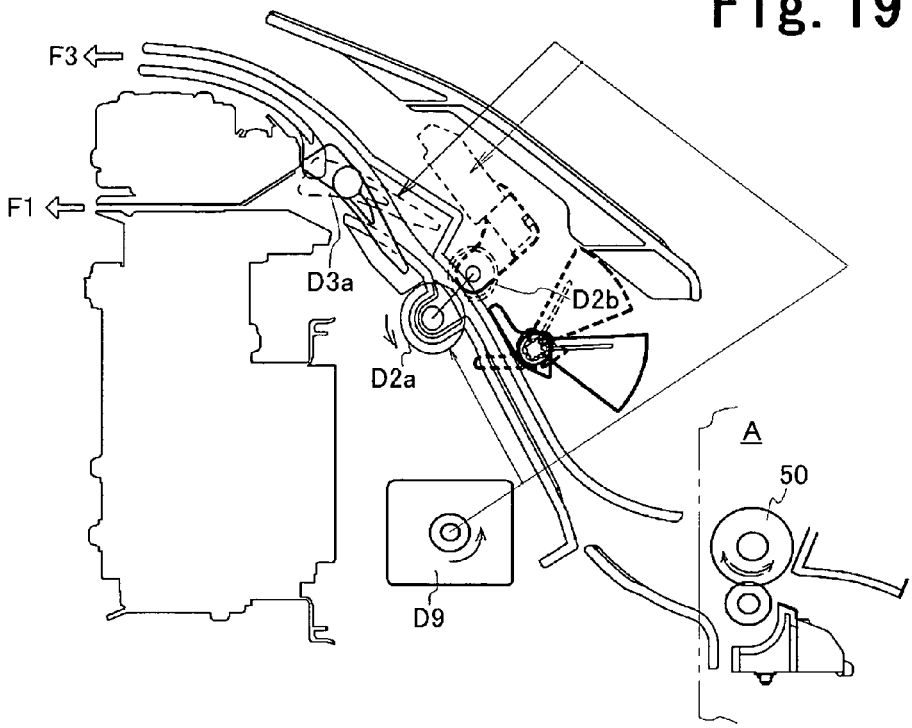
FIG. 19 is a second operation explanatory view to explain another Embodiment of the first unit in the sheet post-processing apparatus.

Next, FIGS. 18 and 19 show another Embodiment according to the application concerned, and the difference from the above-mentioned Embodiment is of a sheet post-processing apparatus without the second transport path F2 for discharging the received sheet directly to the storage tray 113, described later, without applying the post-processing of the second unit E and the third unit F. By omitting the second transport path F2, the allocating means D3*a* does not exist, and the allocating means D3*b* is replaced with an allocating means D3. In addition, in the driving coupling system of the first unit in this Embodiment which is switched in driving by forward and backward rotation of the stepping motor D9, the same reference numeral member as in the above-mentioned Embodiment has the same function, is driven in the same way, and constitutes a similar mechanism as in FIGS. 15 and 16.

First, the state as shown in FIG. 18 shows the transport system for feeding the sheet carried out of the sheet forming unit A to the first transport path F1 to apply post-processing to the sheet, a signal such that the post-processing mode is selected is beforehand received from the image forming unit A, the stepping motor D9 is rotated forward, the allocating means D3*a* is thereby in the state shown by the solid line, while the driven roller D2*b* is pressed against the driving roller D2*a*, the driving roller D2*a* is rotated in the sheet transport direction, and it is thereby possible to feed the sheet, which is sequentially carried out of the sheet discharge roller of the sheet discharge section 50 of the image forming unit A, to the first transport path F1. In addition, in this Embodiment, by controlling and operating only the transport system simply with the post-processing operation halted, the sheet is discharged to the collection tray 112 without performing the post-processing on the sheet.

Next, the state as shown in FIG. 19 shows the transport system for feeding the sheet with printing applied to one side to the third transport path F3 used in switching the sheet back and reversing so that the image forming unit A prints on both sides, a signal such that the two-side printing mode is selected is beforehand received from the image forming unit A, the stepping motor D9 is rotated backward, the allocating means D3*a* is thereby in the state shown by the solid line, while the driven roller D2*b* is kept at the state separate from the driving roller D2*a*, the allocating means D3*b* is held at the state shown by the solid line concurrently with rotating the driving roller D2*a* in the sheet transport direction, and the front end of the sheet, which is sequentially carried out of the sheet discharge roller of the sheet discharge section 50 of the image forming unit A, is fed to the third transport path F3 by the sheet discharge roller of the sheet discharge section 50. At this point, the reason why the driving roller D2*a* separated from the driven roller D2*b* is rotated in the sheet transport direction is to smoothly guide the front end of the sheet fed by the sheet discharge roller of the sheet discharge section 50 to the third transport path F3 and thereby prevent the sheet from jamming or buckling. Further, the sheet, which is fed to the third transport path F3 by the sheet discharge roller of the sheet discharge section 50 of the image forming unit A, is switched back by backward rotation of the sheet discharge roller of the sheet discharge section 50 by control of the image forming unit A, and during the period, until the sheet post-processing apparatus C receives a two-side printing finish signal from the image forming unit A, the stepping motor D9 is rotated backward to keep the third transport path F3 as shown in FIG. 19 open.

[Configuration of the Second Unit]

Described next is the second unit E provided with the first post-processing means for performing post-processing such as punching and stamping on the sheet which is sequentially carried out of the first unit D. In this Embodiment, the second unit is comprised of a punching apparatus as the details are shown in FIGS. 20 and 21. The punching apparatus is comprised of a punching mechanism section E1, a shift mechanism section E2 for shifting the punching mechanism section E1 to a punching position corresponding to the size of the sheet to punch and transport position displacement as appropriate to position each punch, and a sensor E3 that detects a front end of the sheet to control shift timing of the shift mechanism section E2. In addition, the punching mechanism section E1 is supported movably by two guide shafts E8 laid over the apparatus body of the second unit E that supports a driving motor of the shift mechanism section E2, and is capable of reciprocating in the direction perpendicular to the sheet carrying-out direction by switching the rotation direction of the driving motor of the shift mechanism section E2.

The punching mechanism section E1 is comprised of a punch driving motor E4 capable of rotating forward and backward, a rotary shaft E5 that rotates by the punch driving motor E4, a plurality of punches E6 which are pressed against the rotary shaft E5 sequentially by cams with different rotation phases and move up and down, a waste box E7 that collects wastes of sheets punched by the punches E6, and a full detection sensor (light emitting element E9 and light receiving element E10) that detects that wastes inside the waste box E7 are a predetermined amount.

Further, the second unit E incorporating the punching apparatus is mutually coupled to the third unit F on their rear side by the hinge G1, and is supported rotatably around the pivot supporting point of the hinge G1. Then, the front side is coupled by the second coupling means G comprised of the lock hook G2 and second operating lever G3 capable of being separate and released by mutual operation. Then, by operating the second operating lever G3 on the front side by manual operation, and releasing the coupling between the second unit E and the third unit F by the lock hook G2, it is possible to separate the second unit E from the front side of the third unit and open space.

Further, the waste box E7 is taken to the front side of the plane of paper in the state of FIG. 20, and is inserted in the punching mechanism section E1 to be removable from the left side of the plane of paper in the state of FIG. 21. Particularly, by opening the front side of the second unit E incorporating the punching apparatus with respect the third unit F, the punching apparatus incorporated into the second unit E is in a horizontally slanting position, it is possible to visually check the waste box storage portion of the punching apparatus from the front of the operation, the front end portion of the waste box can be directly inserted in the waste box storage portion, it is possible to install the waste box by inserting the waste box into the back almost from the front, and the installation performance is excellent. Further, also in removing wastes of the waste box becoming full, there is no need of the crank operation for once pulling the box transversely and pulling out to the front unlike the conventional manner, and wastes do not spill inside the apparatus accidentally.

In addition, in FIG. 20, numerals 2, 3, 4 added to a plurality of punches E6 show punches to operate corresponding to the type of punching processing on the sheet. For example, it is possible to beforehand set so that two-hole processing is performed by forward rotation of the punch driving motor E4 and that three-hole processing or four-hole processing is performed by backward rotation of the motor, and it is possible to set the shapes, phases and the like of the cams so that punches given numeral 2 are only moved up and down by the cams in the case of two-hole processing, punches given numeral 3 are only moved up and down by the cams in the case of three-hole processing, and that punches given numeral 4 are only moved up and down by the cams in the case of four-hole processing. Further, it is possible to perform processing of other holes by increasing the number of punches.

Moreover, it is possible to use a stamping apparatus as a substitute for the punching apparatus. In this case, a stamping mechanism section of the stamping apparatus is disposed as a substitute for the punching mechanism section E1 of the punching apparatus, an ink holder is disposed using the waste box space of the punching apparatus, and it is thereby possible to similarly use.

[Configuration of the Third Unit]

The third unit F as shown in FIG. 9 will be described below. The third unit F is comprised of a processing tray 64 to load sheets, which are sequentially carried out through the second unit E, by a sheet bunch collection mechanism, second post-processing means 100 that performs the post-processing such as width alignment, staple binding and adhesive binding on the sheets in bunch form placed on the processing tray 64, the collection tray 112 disposed on the downstream side of the processing tray 64 to store the sheets subjected to the post-processing, and the storage tray 113 that stores sheets that are directly carried out of the first unit D without being passed through the second unit E. In addition, in this Embodiment, a staple binding apparatus is installed as the second post-processing means 100, and will specifically be described below based on FIGS. 22 to 31.

[Sheet Bunch Collection Mechanism]

Figure 22:
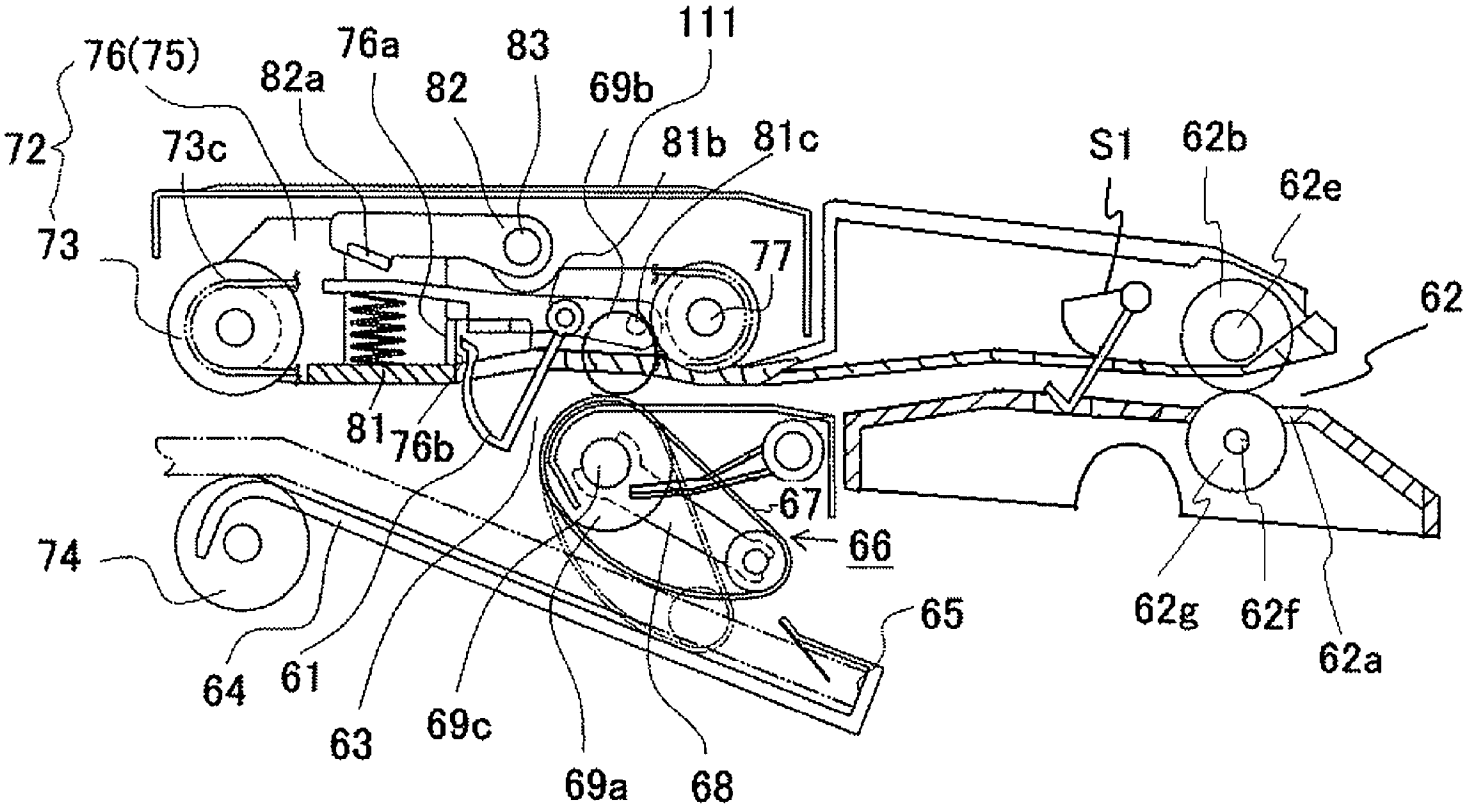
FIG. 22 is a plan sectional view to explain a sheet load mechanism section of a third unit in the sheet post-processing apparatus of FIG. 9.

The sheet bunch collection mechanism for collecting sheets in bunch form on the processing tray 64 will be first described based on FIGS. 20 to 26. As shown in FIG. 22, the sheet bunch collection mechanism is comprised of a sheet discharge path 62 (hereinafter, referred to as a unit sheet discharge path) connected to the sheet discharge outlet of the first unit D, the processing tray 64 to temporarily place sheets from the unit sheet discharge path 62, the second post-processing means 100 (see FIG. 29) that performs the post-processing on the sheets on the processing tray 64, and the collection tray 112 (see FIG. 9) that stores the processed sheets fed from the processing tray 64.

Then, the unit sheet discharge path 62 is provided with a guide plate 62*a* that guides a sheet, and a transport roller 62*b* (driving roller) and transport roller 62*g* (driven roller) that transport the sheet. In addition, "62*f*" denotes a shaft to support the transport roller 62*g* (driven roller) on the guide plate 62*a*. Further, in a sheet discharge outlet 63 of the unit sheet discharge path 62, sheet discharge rollers 69 comprised of a driving roller 69*a* and driven roller 69*b* are provided and carry sheets sequentially out of the sheet discharge outlet 63. On the downstream side of the sheet discharge outlet 63, the processing tray 64 is disposed while forming a height difference. Then, the driving roller 63*a* of the sheet discharge outlet 63 is provided with a carrying means 66 for carrying out the sheet to a positioning means 65 described later. As the carrying means 66 thus provided in the sheet discharge outlet 63, a caterpillar belt, paddle carrying-out mechanism and the like are known, and the means as shown in the figure is comprised of a caterpillar belt 67 such that a plurality of protrusions is formed on the surface of an endless belt and pushes the sheet rear end.

One end of the caterpillar belt 67 is fitted with a pulley provided in the driving shaft 69*c* of the driving roller 69*a* described previously. Then, the other end of the caterpillar belt 67 is fitted with a pulley attached to a support arm 68 axially supported by the driving shaft 69*c* to be swingable. Accordingly, the caterpillar belt 67 is supported to be swingable about the driving shaft 69*c* of the sheet discharge roller 69, the front end of the belt 67 comes into contact with the top of the sheets placed on the processing tray 64, and the base end portion is driven to rotate by the driving shaft 69*c*.

Then, the sheet from the unit sheet discharge path 62 is sequentially carried out of the sheet discharge outlet 63 by the sheet discharge roller 69, fed to the processing tray 64 by the upper surface side of the caterpillar belt 67, and then, reversed and transported along the uppermost sheet on the processing tray 64 by the lower surface side of the belt. In addition, "61" shown in the figure denotes a guide piece provided in the sheet discharge outlet 63, withdraws upward when the sheet front end enters, and guides the sheet rear end to the processing tray direction along the caterpillar belt 67. The processing tray 64 is provided with the positioning means 65 that strikes the sheet to regulate, and the sheet is aligned along the positioning means 65. The positioning means 65 shown in the figure is comprised of a protrusion member that protrudes from the processing tray 64 in a position for striking the rear end of the sheet in the transport direction to regulate.

Figure 23:
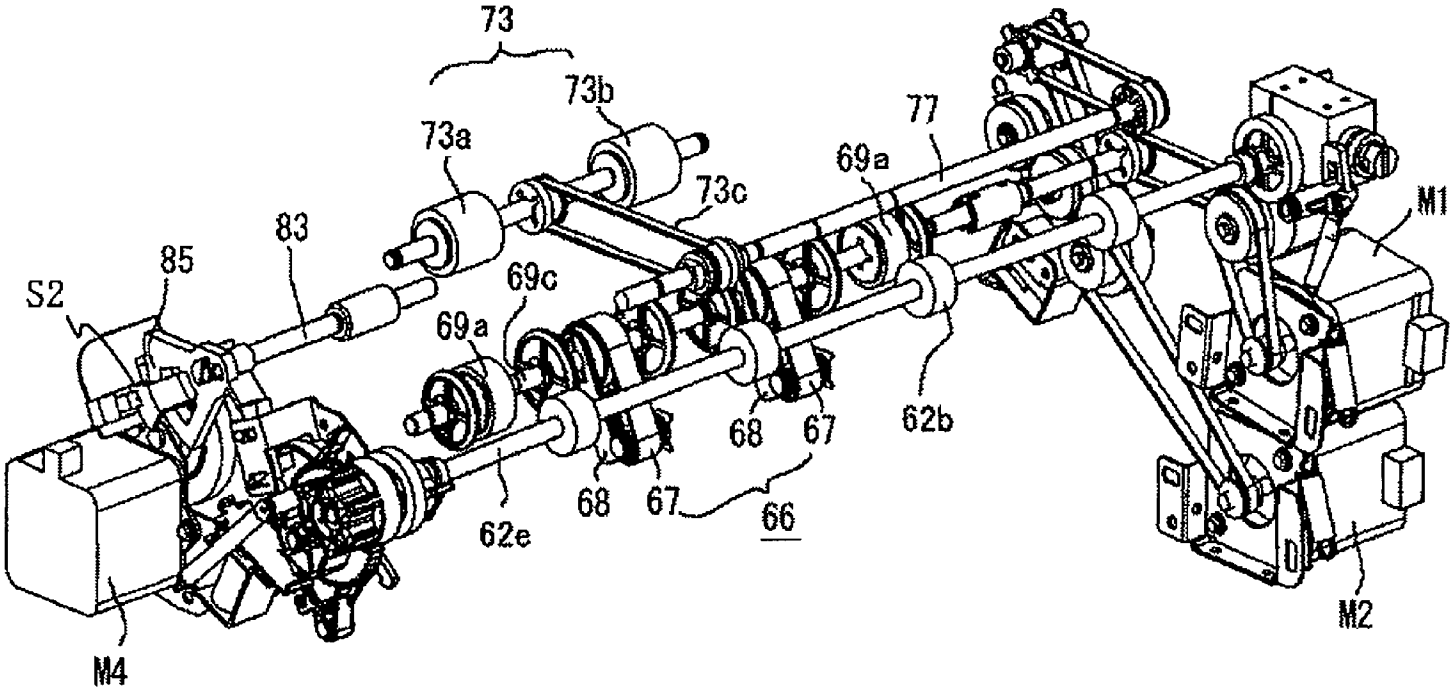
FIG. 23 is a perspective view of the sheet load mechanism section of FIG. 22.
Figure 24:
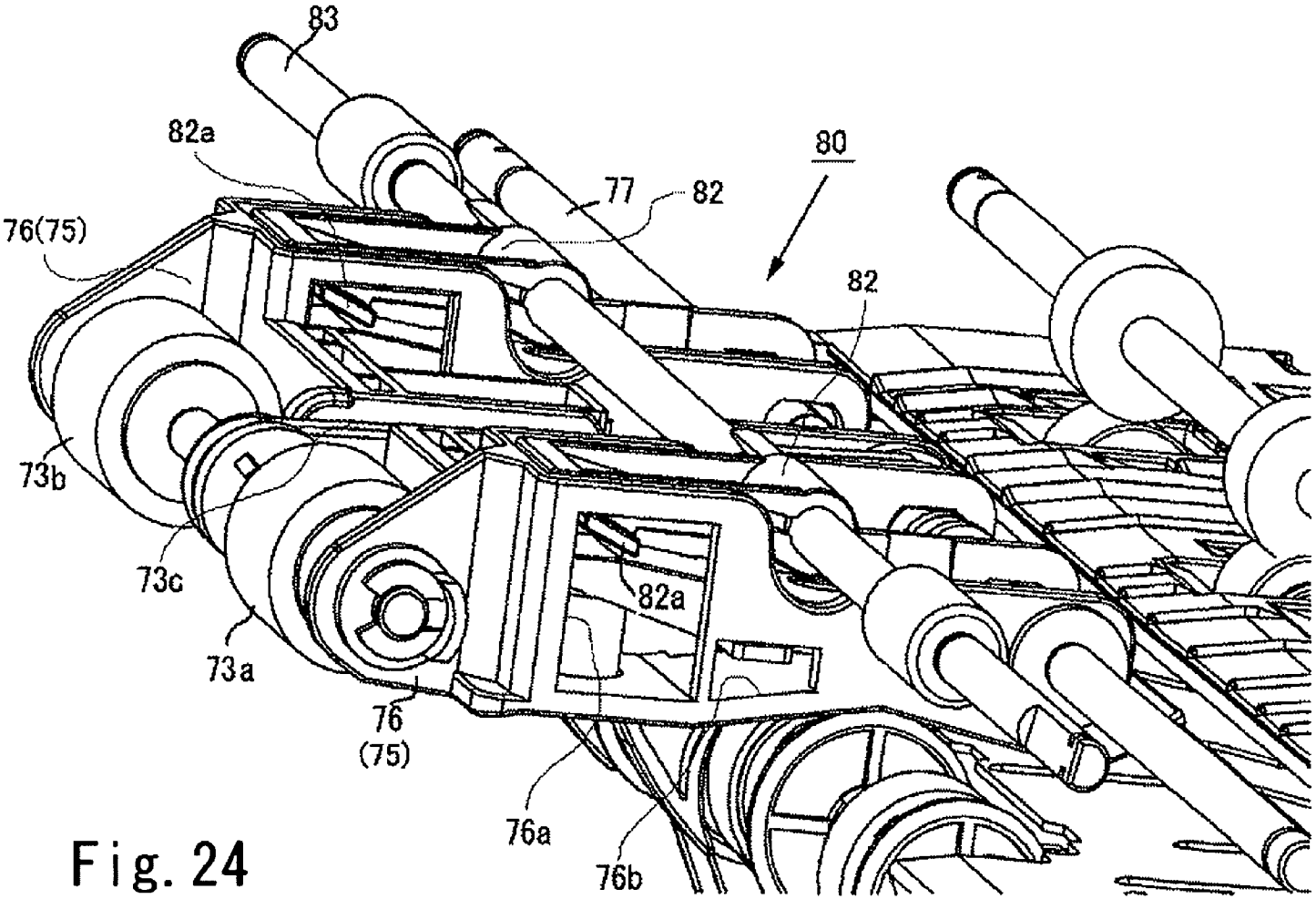
FIG. 24 is an enlarged fragmentary view of FIG. 23.

Further, FIGS. 23 and 24 show perspective views of principal part of the sheet bunch collection mechanism, and the driving mechanism thereof is supported by a left/right side frame 60*a* (see FIG. 30) constituting the unit frame. Then, by the left/right side frame 60*a* are axially supported the driving shaft 69*c* for driving and rotating the sheet discharge roller 69, shaft 62*e* for driving and rotating the transport roller 62*b* (driving roller), a driving rotary shaft 77 of the driving roller 73, and a rotary spindle 83 of a pressing lever 82, the shaft 62*e* and driving shaft 69*c* are coupled to a first transport motor M1, and the driving roller 73 is coupled in the rotary driving shaft 77 to a second transport motor M2.

Figure 25:
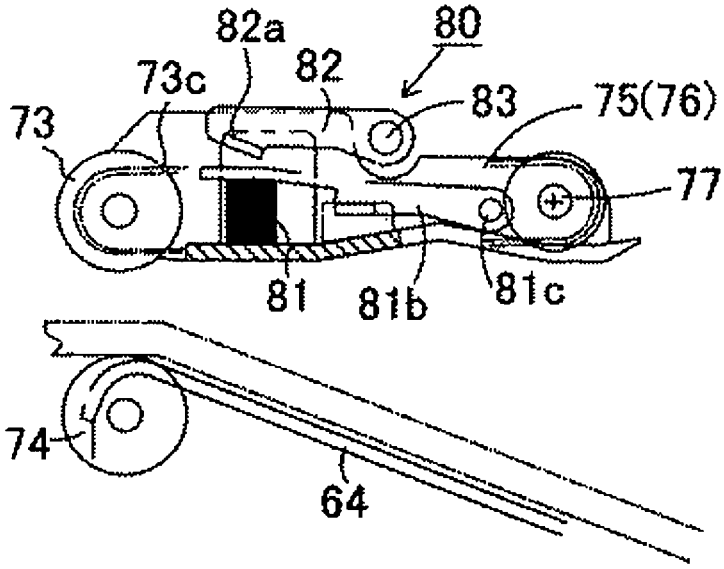
FIG. 25 is a state view in an up position of FIG. 22.
Figure 26:
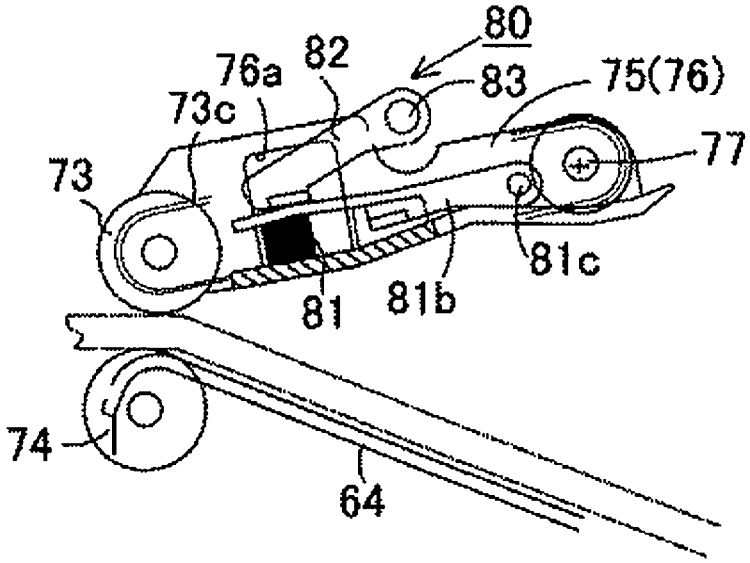
FIG. 26 is a state view in a down position of FIG. 22.

Then, the rotary spindle 83 is coupled to a single (independent) pressing motor M4 via a sector-shaped gear 85, and as shown in FIGS. 25 and 26, the pressing lever 82 moves downward in the direction to come into press-contact with the sheet (moves upward in the direction to separate by backward direction) by pulse control of the pressing motor M4. With downward motion of the pressing lever 82 in the direction to come into press-contact with the sheet, the transport roller 62*b* (driving roller), the driving side discharge roller 69*a* and caterpillar belt 67 in the unit sheet discharge path 62 are driven and rotated in the sheet carrying-out direction, and the rotary driving shaft 77 and the driving roller 73 are coupled in driving by a transmission belt 73*c*. The second transport motor M2 is comprised of a motor capable of rotating forward and backward, carries the sheet carried out of the unit sheet discharge path 62 in the sheet discharge direction, then rotates in the opposite direction after the sheet rear end is carried out onto the processing tray 64, carries the sheet reversely until the sheet rear end reaches the positioning means 65, performs such operation on the sheet that is sequentially carried out, and thereby loads the sheets in bunch form onto the processing tray 64.

Figure 27:
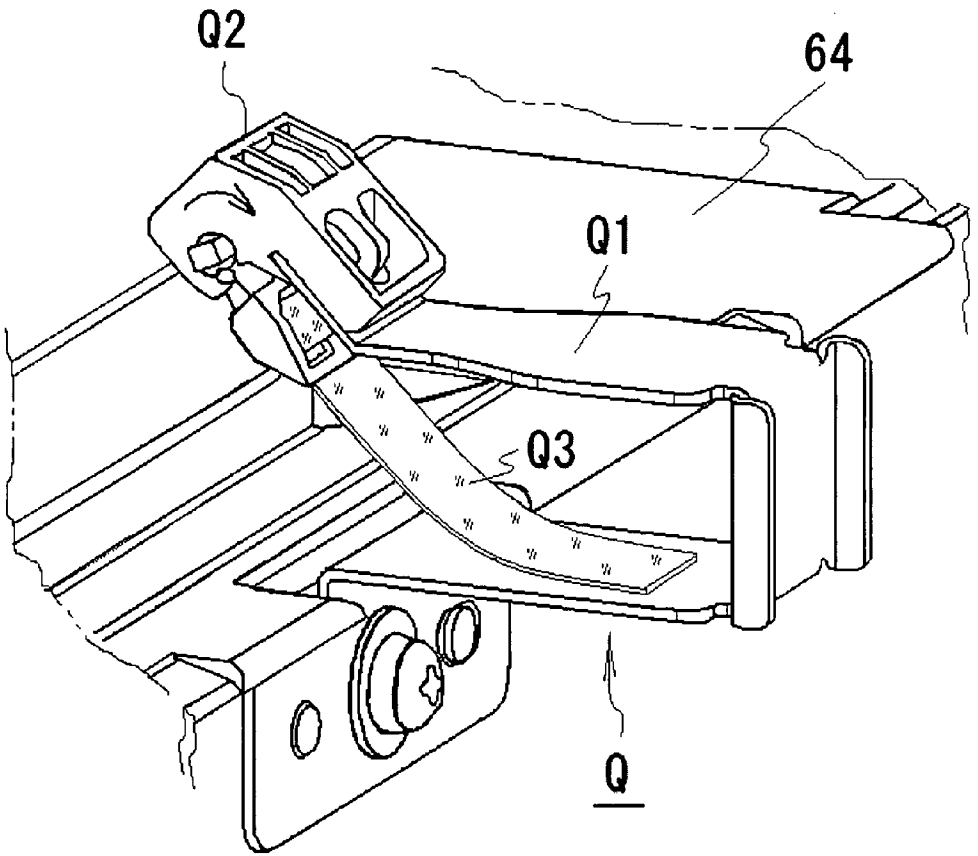
FIG. 27 is an enlarged perspective view of a sheet load stopper portion in FIG. 22.
Figure 28:
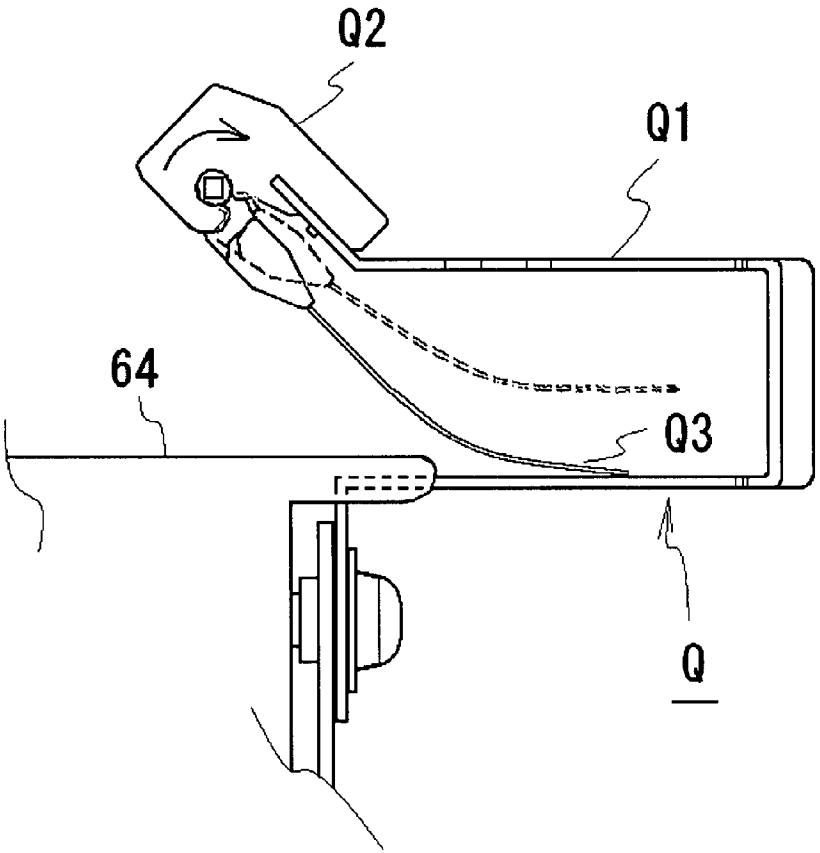
FIG. 28 is a plan view of principal part of FIG. 27.

Further, FIGS. 27 and 28 are enlarged perspective view and plan view of a stopper portion Q that strikes and aligns the front end of the sheet that is drawn by the driving roller 73 of the sheet bunch collection mechanism in loading sheets in bunch form onto the processing tray 64, and particularly, the portion is provided with a mechanism for preventing fluctuations by floating of the front end of the collected sheets. As the mechanism, generally, a thin plastic piece Q3 capable of bowing presses the uppermost collected sheet simply from above. In contrast thereto, as shown in the figures, the plastic piece Q3 is attached to a hold member Q2 that is supported swingably by a stopper frame Q1 and that is biased in a clockwise direction shown by the arrow by a spring member, not shown, and is supported swingably in a counterclockwise against the biasing force of the spring member corresponding to a load amount of sheets to load. By this mechanism, the plastic piece Q3 does not bow more than necessary, and is capable of pressing the uppermost sheet in its same shape irrespective of the load amount of sheets to load, sheets drawn by the driving roller 73 of the sheet bunch collection mechanism neither buckle in the front end, nor fail to reach the stopper regulation position, and it is possible to perform loading excellent in formation. In addition, by biasing the hold member Q2 in a clockwise direction shown by the arrow by the spring member, not shown, the biasing force by the spring member is added in addition to the elastic force of the plastic piece Q3, and it is thereby possible to also prevent a robust sheet from floating with reliability.

[Configuration of the Second Post-processing Means]

Figure 29:
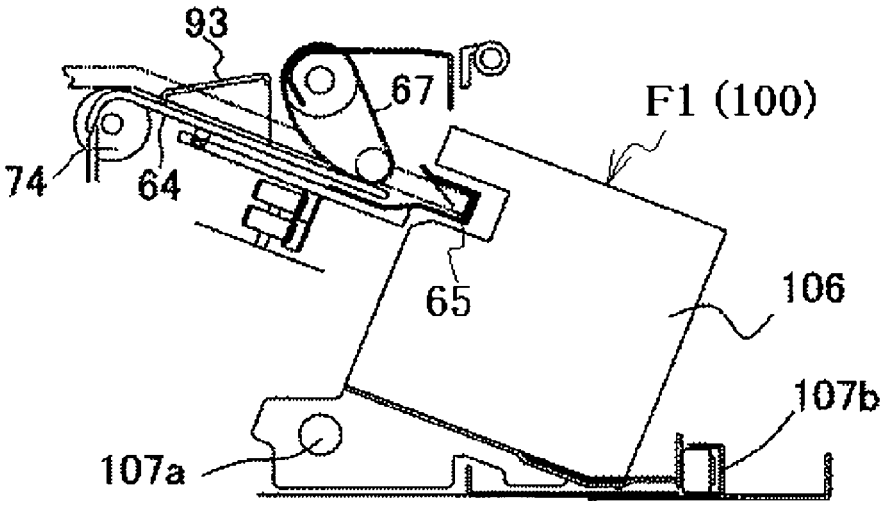
FIG. 29 is a plan sectional view to explain second post-processing of the third unit in the sheet post-processing apparatus of FIG. 9.

Next, as shown in FIG. 29, the sheet bunch, which is regulated by the positioning means 65 and is loaded on the processing tray 64, is subjected to the post-processing such as width alignment, staple binding, adhesive binding or the like by the second post-processing means F. In this Embodiment, a stapler apparatus is disposed as the second post-processing means, and a binding apparatus using an adhesive used in a bookbinding apparatus or the like may be adopted.

Figure 30:
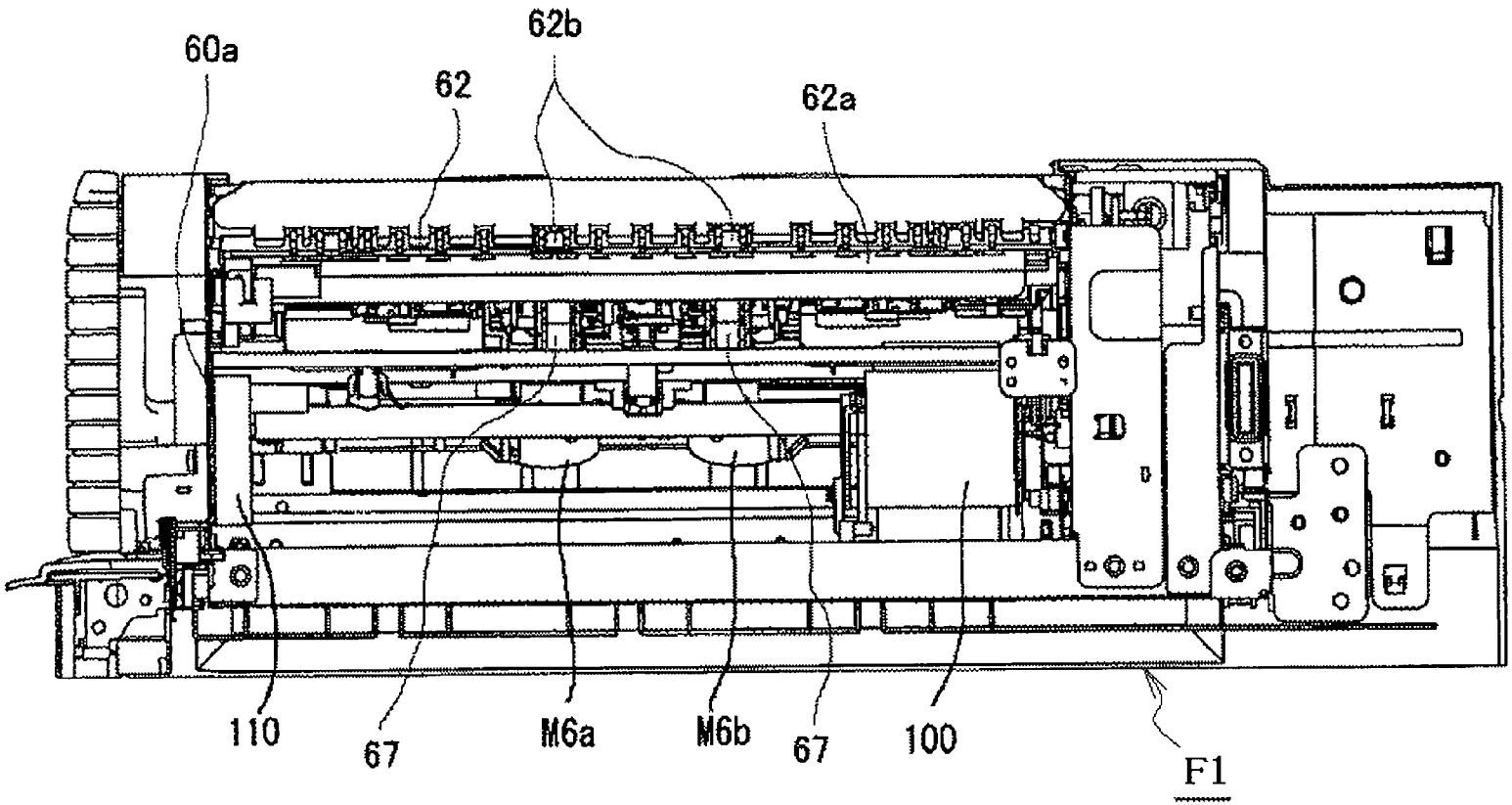
FIG. 30 is a plan view to explain a second post-processing section of FIG. 29.
Figure 31:
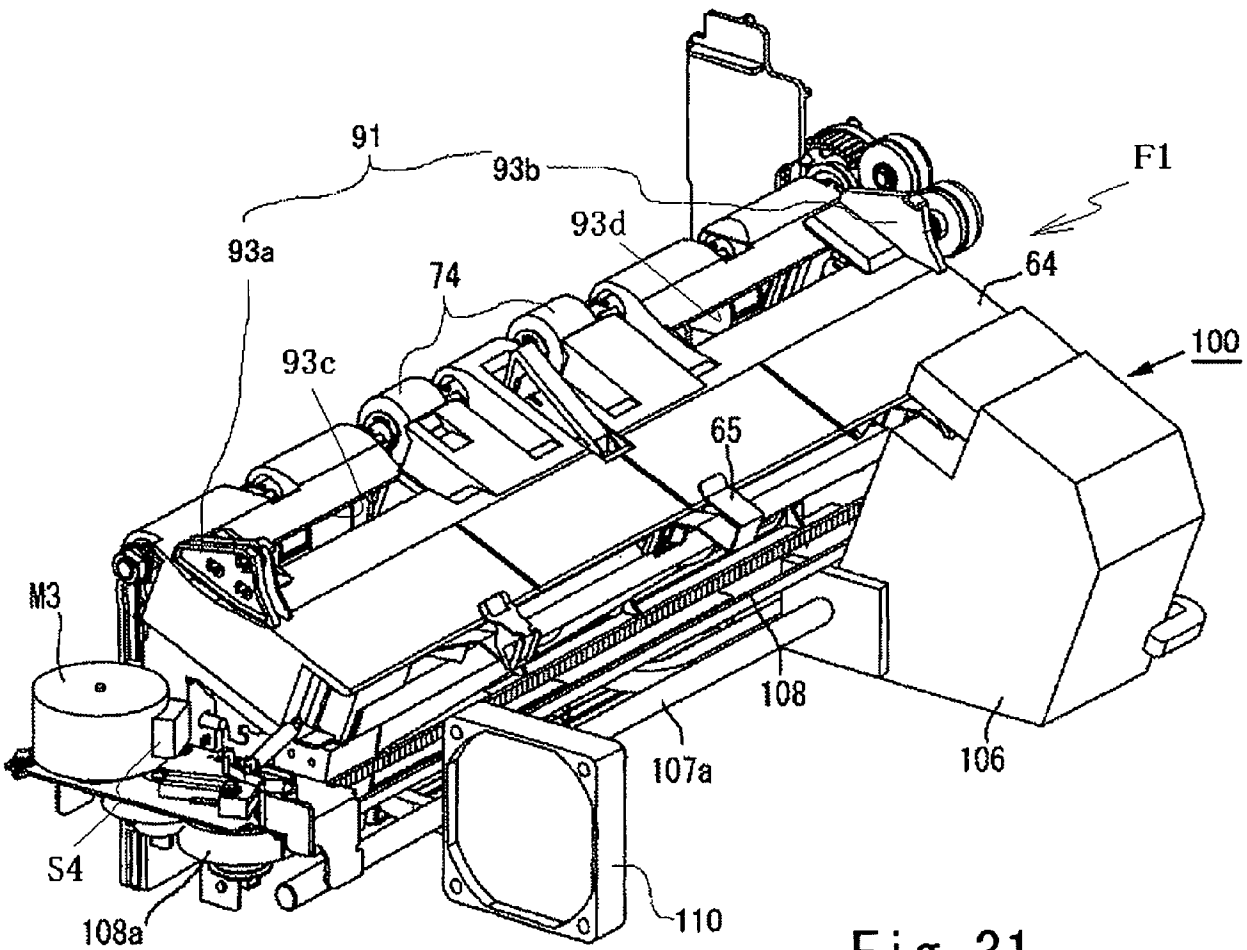
FIG. 31 is a perspective view to explain the second post-processing section of FIG. 29.

Then, the stapler apparatus used as the second post-processing means will specifically be described based on FIGS. 30 and 31. A post-processing apparatus 100 comprised of the staple apparatus 100 is configured by incorporating a staple head and anvil block, not shown, into a housing 106, bending a needle-shaped staple in the shape of a U to press-insert in the sheet bunch, and bending the front ends by the anvil block to bind. The housing 106 is comprised of a frame member of channel-shaped cross section, and the head block and the anvil block are disposed in a pair of left and right side frames 60*a* of the housing to be able to come into press-contact and separate with/from each other. Generally, the head block is attached to one of upper and lower lever members that are supported axially by each other at their base end, and the anvil block is attached to the other one. Then, the upper and lower lever members reciprocate between a separate position and a press-contact position by cam members attached to the side frames 60*a*, and a cam driving motor M5 (not shown) that drives the cam members.

During the operation, the head block bends a linear staple in the shape of a U by a former member, and next, the U-shaped staple is press-inserted in the sheet bunch by a driver member. Meanwhile, the anvil block is provided with an anvil that bends inward the front ends of the press-inserted staple. Accordingly, the post-processing apparatus 100 is comprised of the staple head, anvil block, cam members that move, both the head and the block from the separate position to the press-contact position to perform biding operation, and the cam driving motor M5 (not shown) combined in one unit. In addition, a cartridge that stores staples is attached to the post-processing apparatus 100 to be detachable and exchangeable.

The post-processing apparatus 100 configured as described above is supported by a guide rail 107 provided in the post-processing unit C to be slidable. As shown in FIG. 2, the guide rail 107 is comprised of a guide shaft 107*a* and slider 107*b* attached to the side frame 60*a* of the post-processing unit C, the guide shaft 107*a* is fitted and supported by a fit hole 107*c* formed in the housing 106 of the post-processing apparatus 100, and the slider 107*b* is engaged in a roller provided in the housing 106 and supported. Then, a driving belt 108 is looped between a pair of pulleys along the guide shaft 107*a*, the housing 106 is fixed to a part of the belt 108, one of pulleys, 108*a* (see FIG. 5), is coupled to a unit shift motor M3, the unit shift motor M3 is comprised of a stepping motor and shifts the post-processing apparatus 100 by a predetermined amount corresponding to a supplied pulse current, and the post-processing is applied to the predetermined position of the sheet rear end by the staple mechanism 101.

[Alignment Mechanism]

Further, the processing tray 64 is equipped with an alignment means 91 described below. The alignment means 91 regulates the side edge of the sheet perpendicular to the transport direction, and stores the sheet on the processing tray in a predetermined attitude. In the apparatus shown in the figure, the sheet is carried out of the image forming unit A to the unit sheet discharge path 62 with reference to the center. Therefore, sheets with different width sizes from the sheet discharge outlet 63 are stacked on the processing tray 64 with reference to the center in the transport direction, and the rear end edges are struck by the positioning means 65 described previously.

Then, the alignment means 91 is comprised of a pair of right and left alignment plates 93, right alignment plate 93*a* and left alignment plate 93*b*. The tray-shaped processing tray 64 is provided with slit grooves 93*c*, 93*d* in the width direction, the alignment plates 93 of L-shaped cross section are fitted in the slit grooves 93*c*, 93*d* to be movable, and on the rear side of the processing tray, racks having gears in the direction of the slit grooves 93*c*, 93*b* are provided integrally with the alignment plates 93. The right and left alignment plates 93*a*, 93*b* have the same configuration, and are respectively held in the slit grooves 93*c*, 93*d* to be slidable, and pinions mesh with the integrally-formed racks. Then, each of the right and left pinions is coupled to an alignment motor via reduction gears.

The alignment motor is a stepping motor, and when predetermined power-supply pulses are supplied to the motor, the right and left alignment plates 93*a*, 93*b* move closer and separate to/from each other by the same amount. Each of the alignment plates 93*a*, 93*b* is provided with a position sensor S2, and the home positions are set in positions such that the right and left alignment plates 93*a*, 93*b* are symmetry with respect to the center of the sheet. When the right and left alignment motors M6*a*, M6*b* rotate the same amount, the right and left alignment plates 93*a*, 93*b* shift to the center side from the home positions, and align the sheet side edge in the width. Therefore, when a control section (control CPU 90) of the post-processing unit C receives a width size signal of the sheet carried out of the image forming unit A, and supplies power-supply pulses corresponding to the sheet width to the alignment motors M6*a*, M6*b*, the right and left alignment plates 93*a*, 93*b* shift to standby positions corresponding to the sheet size, and after the sheet is carried onto the processing tray 64, are capable of aligning the sheet in the width and positioning neatly with reference to the center.

[Post-processing-processed Sheet Bunch Discharge Mechanism]

A transport mechanism for carrying the processed-sheet out of the processing tray 64 will be described below using FIG. 22. The processing tray 64 is provided with a transport means 72 that carries out the sheet to the adjacent collection tray 112 (see FIG. 9). The transport means 72 is comprised of a driving roller 73 that transports the sheet, and a roller support means 75 that supports the driving roller 73 to be movable between an operating position to come into press-contact with the sheet and a withdrawal position to separate from the sheet.

In the apparatus as shown in the figure, the driving rotary shaft 77 fixed to the unit frame (not shown) is provided with an arm member 76 axially supported at its base end portion, two driving rollers 73*a*, 73*b* are axially supported on the front end of the arm member 76 in the sheet width direction, driving of the driving rotary shaft 77 is conveyed to the driving roller 73 by the transmission belt 73*c*, and the transport means 72 is thus configured. Accordingly, the driving roller 73 rotates in the sheet transport direction by driving of the driving rotary shaft 77, and concurrently therewith, swings around the driving rotary shaft 77 and is supported to be able to move up and down between the operating position to come into press-contact with the sheet on the processing tray 64 and the withdrawal position.

Then, the arm member 76 is provided with a pressing force applying means 80 described below. As in the arm member 75, the rotary spindle 83 fixed to the unit frame (not shown) is provided with a pressing arm 82 axially supported at its end portion, and the front end portion thereof engages in the arm member 76. The rotary spindle 83 is coupled to the pressing motor M4 comprised of a stepping motor via the driving gear 86 and the integrally-provided sector-shaped gear 85, and by forward and backward rotation of the pressing motor M4, the pressing lever 82 moves up when the rotary spindle 83 rotates in a counterclockwise direction in FIG. 9, while moving down in a clockwise direction.

Further, the sector-shaped gear 85 is provided with an upper limit stopper 85*a* that inhibits upward movement more than a predetermine amount, and the stopper comes into contact with the frame unit (not shown) and prohibits further upward movement. Similarly, the section-shaped gear 85 is integrally provided with an actuator 85*b*, and the position sensor S2 attached to the unit frame detects the actuator. Accordingly, the position sensor S2 detects an original position of the section-shaped gear 85, the pressing motor M4 rotates a predetermined amount in a predetermined direction using the position as the starting point, and it is thereby possible to control up and down operation of the pressing lever 82.

Therefore, the pressing lever 82 is provided at its front end with a wing-shaped engagement piece 82*a*, and the engagement piece 82*a* is fitted with an engagement groove 76*a* formed in the arm member 76. Then, a force-storing spring 81 is provided between the arm member 76 and the pressing lever 82, downward movement of the pressing lever 82 is conveyed to the arm member 76 via the force-storing spring 81, and the driving roller 73 is axially supported by the arm member 76. Meanwhile, by upward movement of the pressing lever 82, the engagement piece 82*a* comes into contact with the top wall of the engagement piece 76*a*, and moves the arm member 76 upward.

Accordingly, by forward and backward rotation of the pressing motor M4, the pressing lever 82 moves the arm member 76 upward and downward, and in moving downward, the driving roller 73 is pressed against the sheet on the processing tray 64 via the force-storing spring 81. The pressing force is capable of being increased or decreased by control of the pulse current supplied to the pressing motor M4. In addition, "81*b*" shown in the figure denotes a buffer lever, and is axially supported by the unit frame in the shaft 81*c*, and the front end portion is disposed between the force-storing spring 81 and the pressing lever 82 and is fitted with an engagement hole 76*b* of the arm member 76 to hold the spring.

Meanwhile, in the processing tray 64, a pinch roller 74 is disposed in a position opposed to the driving roller 73, and the sheet on the processing tray 64 is nipped by the driving roller 73 and the pinch roller 74. On the downstream of the processing tray 64 with such a configuration, the collection tray 112 is provided and stores the processed sheets fed by the transport means 72.

The collection tray 112 shown in the figure is cantilever-supported by the unit frame (not shown), and is supported to be able to move up and down along the guide rail on the frame side. Then, not shown in the figure, the collection tray 112 moves down corresponding to a load amount of sheets by a tray up-and-down motor M7, and always keeps the position of the uppermost sheet in a predetermined position. "112*a*" shown in the figure denotes a sensor that detects the sheet height, and "112*b*" denotes an actuator thereof. The sensor 112*a* detects a full loading, concurrently with detecting the height position of the sheets on the tray.

[Post-processing Unit Pull-out Mechanism]

The post-processing unit C as described above is comprised of a unit separated from the image forming unit A, the above-mentioned processing tray 64, and guide shaft 107*a* and slider 107 that support (bear) the post-processing apparatus 100 are fixed to the left/right side frame 60*a*, further the guide rail 107 that supports the collection tray 112 to be movable up and down is fixed, and the post-processing unit C is installed to the sheet discharge outlet 51 of the image forming unit A as a unit.

Then, as shown in FIGS. 3 and 4, the first unit D is attached to the image forming unit A, and the post-processing unit C is incorporated so as to enable the unit C to be installed and removed in/from the first unit D in drawer form. Therefore, the side frames 60*a*, 60*b* and the frame of the image forming apparatus are provided with guide rails G4 from side to side, both are fitted with each other to be slidable, and in the installation state as shown in FIGS. 1 and 2, connectors for power supply and transfer of various signals are coupled to the image forming unit A.

Further, the first unit D is provided with a hold lever (hold means) for holding the second unit E and the third unit F in the pull-out positions, and safety is ensured so that the second unit E and the third unit F do not move accidentally during removal of a sheet remaining in the first unit D.

[Post-processing Unit Control]

Figure 32:
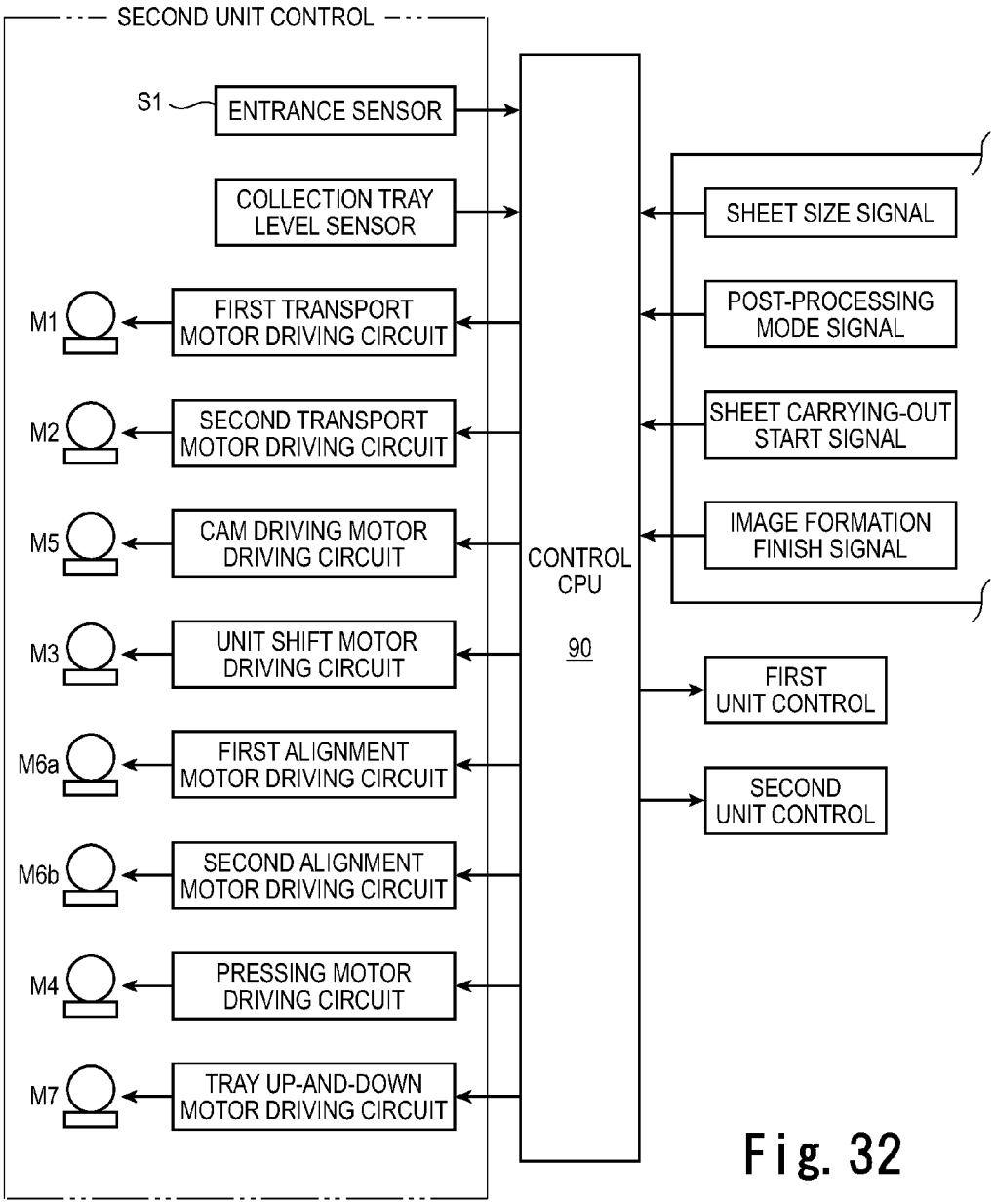
FIG. 32 is a block diagram illustrating control of the sheet post-processing apparatus according to the invention.

Control of the control CPU 90 mounted on the post-processing unit C will be described below based on FIG. 32. The control CPU 90 receives a mode direction signal of post-processing, a signal (post-processing start signal) for conveying finish of discharge of a series of sheets (to apply the post-processing) and a signal (size signal) for conveying a sheet size from the image forming unit A. Further, the control CPU 90 receives a signal of an entrance sensor S1 (see FIG. 9) provided in the unit sheet discharge path 62 to detect the front end and rear end of the sheet, a signal of a level sensor S3 (see FIG. 9) of the collection tray 112, a signal of the position sensor of the alignment means 91 (see FIG. 31), a signal of the position sensor S2 (see FIG. 23) of the section-shaped gear 85 installed with the rotary spindle 83 of the pressing lever 82, and a signal of a position sensor S4 (see FIG. 31) of the post-processing apparatus 100.

Meanwhile, the control CPU 90 is connected to driving circuits of the first transport motor M1 and second transport motor M2, driving circuits of the alignment motors M6*a*, M6*b* of the alignment plates 91, driving circuits of the unit shift motor M3 of the post-processing apparatus 100 and the cam driving motor M5, and a driving circuit of the pressing motor M4 coupled to the pressing lever 82 so as to issue control signals to respective driving circuits.

Each operation will be described below. The control CPU 90 constituting control signals of the unit C executes each following operation for the post-processing unit C as described above. In addition, in accordance with the above-mentioned Embodiment, control is described in installing the punching apparatus as the second unit E and the stapler apparatus as the third unit F. When another post-processing apparatus is selected and coupled, it is possible to substitute and couple to each control apparatus that controls driving of the selected post-processing apparatus to execute.

[First Unit Control]

First, upon receiving a direction signal of sheet discharge from the image forming unit A, the control CPU 90 controls the first unit. As the operation, first, the CPU 90 drives a driving motor, not shown, which is provided in the first unit D and is capable of rotating forward and backward, to rotate the transport roller pair D2 in the sheet carrying-out direction, while receiving a signal indicating whether or not to apply the post-processing to the received sheet, and switches the allocating means D3 as appropriate to guide the sheet to either the first transport path F1 in the cases of discharging the sheet directly to the sheet discharge stacker without applying the post-processing and of duplex as described previously, or the second transport path F2 for discharging to the processing tray after performing the post-processing of the third unit F via the second unit E to apply the post-processing. In addition, in the duplex, the CPU 90 receives a signal indicating that the rear end of the carried-out sheet is discharged to a predetermined position from the image forming unit A, and performs control so that the driving motor provided in the first unit D is rotated backward, and that the sheet with the front end fed to the first transport path F1 is switched back and fed to a reverse unit 60 of the image forming unit A.

[Second Unit Control]

Next, upon receiving a direction signal of the first post-processing (in this Embodiment, punching processing) from the image forming unit A, the control CPU 90 controls the punching apparatus E1 installed in the second unit E. As the operation, first, the CPU 90 switches the direction of the allocating means D3 so as to feed the carried-out sheet to the inside of the second transport path F2, and carries the carried-out sheet to a punching position of the punching apparatus E1 installed in the second unit E. Then, when the front end of the carried-out sheet is detected by the sensor E3 as shown in FIGS. 20 and 21 and the CPU 90 receives the detection signal, the control CPU 90 processes information of a size of the carried-out sheet beforehand received from the image forming unit A, a skew amount by a skew detection signal not shown, etc. shifts the punching apparatus E1 positioned in the home position by the driving motor of the shift mechanism section E2 to wait during a period in which the rear punching portion of the carried-out sheet reaches the punching position, calculates the timing at which the punching portion reaches the punching position from the transport velocity of the carried-out sheet and performs the punching processing.

Further, corresponding to the type (two-hole, three-hole. four-hole, other-hole, etc.) of the punching processing on the sheet that is beforehand received from the image forming unit A, the control CPU 90 rotates the punch driving motor E4 (see FIG. 20; the case where settings are beforehand made so as to enable two-hole in forward rotation and four-hole in backward rotation in this Embodiment) capable of rotating forward and backward forward in the case of two-hole processing, while rotating backward in the case of four-hole processing, to perform the punching processing on the carried-out sheet.

Furthermore, when wastes in the waste box E7 become full, the control CPU 90 receives a signal of the light receiving element E10 of the full detection sensor (light emitting element E9 and light receiving element E10), displays that the waste box E7 is full in the image forming unit A for the user, and controls feedback such as halt of copying operation of a subsequent sheet or the like.

[Third Unit Control]

Next, upon receiving a direction signal of the second post-processing (stapler binding processing in this Embodiment) from the image forming unit A, the control CPU 90 starts the first transport motor M1 as described in FIG. 23, and rotates the transport roller 62*b* (driving roller), sheet discharge roller 69*a* and caterpillar belt 67 (carrying means) coupled thereto in the sheet discharge direction. Concurrently therewith, the control CPU 90 rotates a driving motor of a cooling fan 110 shown in FIG. 31, while controlling rotation of the unit shift motor M3 of the post-processing apparatus 100, and positions the post-processing apparatus 100 in a predetermined position. The predetermined position of the post-processing apparatus 100 is beforehand set so that air from the cooling fan 110 is deflected to the guide plate 62*a* of the unit sheet discharge path 62.

[Sheet Bunch Collection Control]

Next, upon obtaining a size signal of the image forming unit A, the control CPU 90 drives the alignment motors M6*a* and M6*b* of the alignment means 91. The CPU 90 shifts the right and left alignment plates 93*a*, 93*b* to standby positions slightly larger than the width size of the fed sheet by the alignment motors M6*a* and M6*b*. To control the alignment motors M6*a*, M6*b*, the motors are supplied with power-supply pulses set so as to shift the right and left alignment plates 93*a*, 93*b* from respective home positions to standby positions that are beforehand set corresponding to the sheet size. The control CPU 90 issues the number of power-supply pulses.

Further, upon obtaining a sheet rear end detection signal from the entrance sensor S1 of the unit sheet discharge path 62, the control CPU 90 shifts the driving roller 73 from the withdrawal position to the operating position after a lapse of predicted time the sheet reaches on the processing tray 64. For this control, the pressing motor M4 coupled to the rotary spindle 83 of the pressing lever 82 is rotated in a counterclockwise direction in FIG. 22. This rotation amount is beforehand set to add adequate transport force to carry out the sheet bunch on the processing tray 64. By rotation of the pressing motor M4, the pressing lever 82 swings in a counterclockwise direction in FIG. 22, and the front end of the lever presses the force-storing spring 81 downward to press the driving roller 73. After pressing the driving roller 73 from the withdrawal position to the operating position, the control CPU 90 drives and rotates the second transport motor M2. Then, the sheet that is carried out onto the processing tray 64 is reversed, and is fed by the driving roller 73 with the rear end side directed toward the positioning means 65 on the processing tray 64.

Then, the control CPU 90 halts the second transport motor M2 after a lapse of predicted time the sheet rear end reaches the positioning means 65. Concurrently therewith, the control CPU 90 rotates the operation motor M4 of the pressing lever 82 backward to shift the driving roller 73 to the withdrawal position, and then, halts.

Thus, after feeding the sheet to the predetermined position on the processing tray 64, the control CPU 90 executes the following operation to align the sheet. In other words, after a lapse of predicted time the sheet reaches the positioning means 65 from the sheet rear end detection signal from the entrance sensor S1, the control CPU 90 drives the alignment motors M6*a*, M6*b* by predetermined amounts, and shifts the right and left alignment plates 93*a*, 93*b* by predetermined amounts with reference to the center of the sheet. Then, the sheet carried on to the processing tray 64 is aligned while being aligned in the right and left side edges by the alignment plates 93.

Also for control of the alignment motors M6*a* and M6*b*, the control CPU 90 conveys the number of pulses of power supply to the driving circuits so that the plates reciprocate between the standby position and the alignment position (the stroke is beforehand set corresponding to the sheet width size). Thus, after sequentially carrying out a series of sheets, the control CPU 90 receives a finish signal of image formation from the image forming unit A, and starts and controls the unit shift motor M3 of the post-processing apparatus 100. Concurrently therewith, the control CPU 90 halts the first transport motor M1 and the second transport motor M2. The post-processing apparatus 100 shown in the figure is comprised of a stapler, and is shifted to a set position corresponding to a processing mode signal beforehand transmitted from the image forming unit A.

[Stapler Binding Control]

As described above, the control CPU 90 repeats the operation from carrying out to alignment of the sheet, receives an image formation finish signal from the image forming unit A with a series of sheets from the image forming unit A loaded on the processing tray 64, and executes the post-processing. As a processing mode of the stapler shown in the figure, center two-portion binding, corner binding or other binding position is beforehand set. In binding two center portions, the control CPU 90 controls the motor M3 so as to shift the post-processing apparatus 100 to a first position calculated corresponding to the sheet size, and sends a command signal of processing execution to the post-processing apparatus 100 to execute the processing. After completion of the processing operation, the control CPU 90 shifts the post-processing apparatus 100 again to the next position, and outputs a signal of processing execution. The unit shift motor M3 of the post-processing apparatus 100 shifts the post-processing apparatus 100 to a predetermined position in the rotation direction based on the command signal output from the control CPU 90 and in the rotation amount based on the number-of-pulse direction signal.

[Sheet Bunch Discharge Control]

Then, after finishing the post-processing operation, the control CPU 90 carries out the processed-sheets on the processing tray 64 to the collection tray 112. First, the control CPU 90 sets the number of revolutions of the motor at this point so as to add the predetermined circumferential velocity to the driving roller 73, and the sheets nipped with the pinch roller 74 are carried out toward the collection tray 112 by rotation of the driving roller 73.

Next, the control CPU 90 calculates a distance between the position of the driving roller 73 and the positioning means 65 for the sheet rear end, decreases the rotation velocity of the second transport motor M2 to the second velocity immediately before the sheet rear end reaches the roller position, and concurrently therewith, reduces the pressing force of the pressing lever 82. This is because of preventing the sheet rear end from distorting by reducing the velocity and pressing force (nip force with the driven roller) when the sheet rear end separates from the driving roller 73.

Upon receiving a command signal (for example, an operation finish signal of the post-processing apparatus) of sheet carrying-out, the control CPU 90 drives the pressing motor M4, shifts the driving roller 73 to the operating position to come into contact with the sheets by the pressing lever 82, and for example, sets so that the force of 10 newtons is applied to the sheets. After the operation, the CPU 90 halts the pressing motor M4 so that the predetermined pressing force (10 N) is acted on the driving roller 73 from the pressing lever 82. Next, the control CPU 90 starts the second transport motor M2 to drive the driving roller 73 at a first circumferential velocity of 450 mm/sec. Then, the sheets on the processing tray 64 are nipped between the driving roller 73 and pinch roller 74 and are carried out toward the collection tray 112.

What is claimed is:

1. A sheet post-processing apparatus comprising:

a first unit provided with guide means for guiding a sheet that is sequentially carried in;

a second unit provided with first post-processing means for performing post-processing to punch and stamp on the sheet that is sequentially carried out of the first unit; and a third unit provided with a processing tray to load sheets that are sequentially carried out through the second unit, second post-processing means for performing post-processing including width alignment, staple binding and adhesive binding on the sheets in bunch form placed on the processing tray, and a collection tray disposed on the downstream side of the processing tray to store the sheets subjected to the post-processing, wherein the first, second and third units are successively provided parallel in a sheet carrying-out direction, the apparatus further has first coupling means for coupling the first unit and at least one of the second unit and third unit, second coupling means for coupling the second unit and the third unit, and shift inhibiting means for inhibiting shift of the second unit to a first unit side due to release of the second coupling means, the second unit and the third unit are capable of being pulled out in the sheet carrying-out direction with respect to the first unit by releasing the first coupling means, the entire or front side of the second unit is capable of shifting to the first unit side with respect to the third unit by releasing the second coupling means, and the apparatus reserves clearance opened widely between the first unit and the second unit located in a pull-out position, the second unit and the third unit are pulled out in the sheet carrying-out direction by releasing the first coupling means, the second unit and the third unit are stopped in pull-out positions by the shift inhibiting means, and the entire or front side of the second unit released by the second coupling means is capable of shifting to the first unit side after releasing inhibition of the shift inhibiting means.

2. The sheet post-processing apparatus according to claim 1, wherein the guide means of the first unit is comprised of a pair of guide plates for guiding frontside and backside of the carried-in sheet, and a pair of transport rollers that are supported by the pair of guide plates to be mutually rotatable and that nip and transport the carried-in sheet, and a guide plate on the second unit side of the pair of guide plates is opened in conjunction with inhibition release of the shift inhibiting means so as to release a nip of the pair of transport rollers.

3. The sheet post-processing apparatus according to claim 1, wherein the second unit and the third unit are supported to be movable by a pair of front and back guide rails provided in parallel with each other in the sheet carrying-out direction, and the second unit separates parallel from the third unit by releasing the second coupling means.

4. The sheet post-processing apparatus according to claim 1, wherein the second unit and the third unit are mutually supported on their rear side swingably by a hinge mechanism, the second unit is supported on its front side by a lock mechanism to be capable of being coupled/released to/from the third unit, and one of the second unit and the third unit is provided with releasing means for releasing coupling of the lock mechanism.

5. The sheet post-processing apparatus according to claim 4, wherein the shift inhibiting means inhibits open on the front side of the second unit to the first unit side due to coupling release of the second coupling means, and the second unit and the third unit are held in pull-out positions by the shift inhibiting means, and open on the front side of the second unit coupling-released by the second coupling means is capable of being created after releasing hold of the shift inhibiting means.

6. The sheet post-processing apparatus according to claim 4, wherein the first post-processing means is a punching apparatus, and by opening the front side of the second unit to the first unit side, storage space is provided which enables a punching waste box to be installed in a substantially center portion of the inclined punching apparatus, from the downstream side in the sheet carrying-out direction and the front side.

7. The sheet post-processing apparatus according to claim 6, the shift inhibiting means inhibits open on the front side of the second unit to the first unit side due to coupling release of the second coupling means, open on the front side of the second unit coupling-released by the second coupling means is created by releasing hold of the shift inhibiting means, and the punching waste box is removed from the storage space.

8. The sheet post-processing apparatus according to claim 7, wherein the second post-processing means is a stapler apparatus comprised of a main body of a stapler and a staple storing portion detachable from the main body, the stapler apparatus has a shift mechanism that shifts to the front side of the apparatus by a replenishment signal (end, near end, manual) of staples of the staple storing portion, and with the front side of the second unit coupling-released by the second coupling means opened widely by releasing hold of the shift inhibiting means, the staple storing portion of the stapler apparatus is capable of being removed from the opened front side.

9. The sheet post-processing apparatus according to claim 1, wherein the first unit is provided with sheet transport means having a sheet transport roller pair comprised of a driving roller and a driven roller that are capable of coming into press-contact and separating with/from each other on the upstream side in a sheet transport direction for transporting the sheet, and sheet allocating means for allocating the sheet to a post-processing transport path or a switchback transport path at a branch point for branching the post-processing transport path for guiding the sheet to the post-processing section on the downstream side in the sheet transport direction, and the switchback transport path for receiving the sheet which is fed from a sheet carry-in entrance by the forward/backward rotation roller and is returned by switchback, and control means having first control means for switching the allocating means to the post-processing transport path side while bringing the sheet transport roller pair into press-contact, and second control means for switching the allocating means to the switchback transport path side while separating the sheet transport roller pair.

10. The sheet post-processing apparatus according to claim 9, further comprising:

a forward/backward rotation motor that rotates forward and backward by the control means;

rotation direction converting means for converting both forward rotation and backward rotation of driving means into a rotation direction for rotating the driving roller in the sheet transport direction; and driving means in which the first control means rotates the forward/backward rotation motor forward to switch the allocating means to the post-processing transport path side, while bringing the sheet transport roller pair into press-contact to rotate the driving roller in the sheet transport direction, and the second control means rotates the forward/backward rotation motor backward to switch the allocating means to the switchback transport path side, while separating the sheet transport roller pair to rotate the driving roller in the sheet transport direction.

11. The sheet post-processing apparatus according to claim 10, wherein the rotation direction converting means is comprised of two one-way clutches coupled to the rotary shaft that supports the driving roller of the sheet transport roller pair and the forward/backward rotation motor to drive, and the two one-way clutches are configured so that when the forward/backward rotation motor rotates forward, one of the clutches conveys the rotation to the rotary shaft to drive and rotate the driving roller in the sheet carrying-out direction, while the other clutch idles, and that when the forward/backward rotation motor rotates backward, one of the clutches idles, while the other clutch conveys the rotation to the rotary shaft to drive and rotate the driving roller in the sheet carrying-out direction.

12. The sheet post-processing apparatus according to claim 10, wherein the driving means is provided with a coupling mechanism for coupling the allocating means for switching the sheet to the switchback transport path side and the forward/backward rotation motor to drive, and the coupling mechanism is comprised of a one-way clutch that idles by forward rotation of the forward/backward rotation motor, while being driven by backward rotation of the forward/backward rotation motor, a strike member and a torque limiter that regulate a swing range of the one-way clutch being driven by backward rotation of the forward/backward rotation motor, cam means for slaving by rotation of the one-way clutch, and a swing lever that swings by the cam means to drive the allocating means.

13. The sheet post-processing apparatus according to claim 9, wherein the coupling means separates the driven roller from the driving roller by backward rotation of the forward/backward rotation motor.

14. The sheet post-processing apparatus according to claim 1, wherein the first unit is provided with sheet transport means having a sheet transport roller pair comprised of a driving roller and a driven roller that are capable of coming into press-contact and separating with/from each other on the upstream side in a sheet transport direction for transporting the sheet, a first branch point for branching a post-processing transport path for feeding the sheet to the post-processing section on the downstream side in the sheet transport direction, and a non-post-processing transport path for discharging the sheet without feeding to the post-processing section, a second branch point for branching the non-post-processing transport path and a switchback transport path for receiving the sheet which is fed from a sheet carry-in entrance by the forward/backward rotation roller and is returned by switchback, and sheet allocating means comprised of first allocating means provided at the first branch point to allocate the sheet to the post-processing transport path and the non-post-processing transport path, and second allocating means provided at the second branch point to allocate the sheet to the non-post-processing transport path and the switchback transport path, and control means having first control means for switching the allocating means to the post-processing transport path side while bringing the sheet transport roller pair into press-contact, and second control means for switching the allocating means to the switchback transport path side while separating the sheet transport roller pair.

15. An image forming apparatus comprising:

a main body of the image forming apparatus provided with a paper feed section that sequentially feeds sheets on a stacker, a printing section that performs predetermined print on a sheet from the paper feed section, a fusing section that heats and fuses ink on the sheet fed from the printing section, and a sheet discharge section that sequentially carries the sheet from the fusing section out of a sheet discharge outlet;

an image reading apparatus that is disposed above the main body of the image forming apparatus to read an original image set on a platen; and a sheet post-processing apparatus comprised of a first unit provided with guide means for guiding the sheet that is sequentially carried in from the main body of image forming apparatus, a second unit provided with first post-processing means for performing post-processing to punch and stamp on the sheet that is sequentially carried out of the first unit, and a third unit provided with a processing tray to load sheets that are sequentially carried out through the second unit, second post-processing means for performing post-processing including width alignment, staple binding and adhesive binding on the sheets in bunch form placed on the processing tray, and a collection tray disposed on the downstream side of the processing tray to store the sheets subjected to the post-processing, wherein the first, second and third units are successively provided parallel in a sheet carrying-out direction, the sheet post-processing apparatus further has first coupling means for coupling the first unit and at least one of the second unit and third unit, and second coupling means for coupling the second unit and the third unit, the second unit and the third unit are capable of being pulled out in the sheet carrying-out direction with respect to the first unit by releasing the first coupling means, and the entire or front side of the second unit shifts to the first unit side with respect to the third unit by releasing the second coupling means, the sheet post-processing apparatus reserves clearance opened widely between the first unit and the second unit located in a pull-out position, and has shift inhibiting means for inhibiting open on the front side of the second unit to the first unit side due to release of the second coupling means, the second unit and the third unit are pulled out in the sheet carrying-out direction by releasing the first coupling means, the second unit and the third unit are stopped in pull-out positions by the shift inhibiting means, and the entire or front side of the second unit released by the second coupling means shifts to the first unit side after releasing inhibition of the shift inhibiting means.

16. The image forming apparatus according to claim 15, wherein an original reading section is disposed above the main body of the apparatus, the paper feed section is disposed below the main body of the apparatus, the printing section is disposed between the original reading section and the paper feed section, the sheet post-processing apparatus provided with a sheet discharge section is disposed in a space portion of the main body of the apparatus formed by the original reading section, the printing section and the paper feed section, a transport path exit of a switchback transport path for two-side printing is formed on the top face of the sheet post-processing apparatus, it is configured that in two-side printing, a sheet with printing on its one side is drawn back again after a transport front end portion of the sheet is sent to the top face of a sheet post-processing section from the transport path exit so as to undergo switchback transport, and the first unit is provided with sheet transport means having a sheet transport roller pair comprised of a driving roller and a driven roller that are capable of coming into press-contact and separating with/from each other on the upstream side in a sheet transport direction for transporting the sheet, and sheet allocating means for allocating the sheet to a post-processing transport path or a switchback transport path at a branch point for branching the post-processing transport path for guiding the sheet to the post-processing section on the downstream side in the sheet transport direction, and the switchback transport path for receiving the sheet which is fed from a sheet carry-in entrance by the forward/backward rotation roller and is returned by switchback, and control means having first control means for switching the allocating means to the post-processing transport path side while bringing the sheet transport roller pair into press-contact, and second control means for switching the allocating means to the switchback transport path side while separating the sheet transport roller pair.

17. A sheet post-processing apparatus comprising:

a first unit provided with guide means for guiding a sheet that is sequentially carried in;

a second unit provided with first post-processing means for performing post-processing to punch and stamp on the sheet that is sequentially carried out of the first unit; and a third unit provided with a processing tray to load sheets that are sequentially carried out through the second unit, second post-processing means for performing post-processing including width alignment, staple binding and adhesive binding on the sheets in bunch form placed on the processing tray, and a collection tray disposed on the downstream side of the processing tray to store the sheets subjected to the post-processing, wherein the first, second and third units are successively provided parallel in a sheet carrying-out direction, the apparatus further has first coupling means for coupling the first unit and at least one of the second unit and third unit, and second coupling means for coupling the second unit and the third unit, the second unit and the third unit are capable of being pulled out in the sheet carrying-out direction with respect to the first unit by releasing the first coupling means, the entire or front side of the second unit is capable of shifting to the first unit side with respect to the third unit by releasing the second coupling means, and the second unit and the third unit are supported to be movable by a pair of front and back guide rails provided in parallel with each other in the sheet carrying-out direction, and the second unit separates parallel from the third unit by releasing the second coupling means.

18. A sheet post-processing apparatus comprising:

a first unit provided with guide means for guiding a sheet that is sequentially carried in;

a second unit provided with first post-processing means for performing post-processing to punch and stamp on the sheet that is sequentially carried out of the first unit; and a third unit provided with a processing tray to load sheets that are sequentially carried out through the second unit, second post-processing means for performing post-processing including width alignment, staple binding and adhesive binding on the sheets in bunch form placed on the processing tray, and a collection tray disposed on the downstream side of the processing tray to store the sheets subjected to the post-processing, wherein the first, second and third units are successively provided parallel in a sheet carrying-out direction, the apparatus further has first coupling means for coupling the first unit and at least one of the second unit and third unit, and second coupling means for coupling the second unit and the third unit, the second unit and the third unit are capable of being pulled out in the sheet carrying-out direction with respect to the first unit by releasing the first coupling means, the entire or front side of the second unit is capable of shifting to the first unit side with respect to the third unit by releasing the second coupling means, and the second unit and the third unit are mutually supported on their rear side swingably by a hinge mechanism, the second unit is supported on its front side by a lock mechanism to be capable of being coupled/released to/from the third unit, and one of the second unit and the third unit is provided with releasing means for releasing coupling of the lock mechanism.

19. An image forming apparatus comprising:

a main body of the image forming apparatus provided with a paper feed section that sequentially feeds sheets on a stacker, a printing section that performs predetermined print on a sheet from the paper feed section, a fusing section that heats and fuses ink on the sheet fed from the printing section, and a sheet discharge section that sequentially carries the sheet from the fusing section out of a sheet discharge outlet;

an image reading apparatus that is disposed above the main body of the image forming apparatus to read an original image set on a platen; and a sheet post-processing apparatus comprised of a first unit provided with guide means for guiding the sheet that is sequentially carried in from the main body of image forming apparatus, a second unit provided with first post-processing means for performing post-processing to punch and stamp on the sheet that is sequentially carried out of the first unit, and a third unit provided with a processing tray to load sheets that are sequentially carried out through the second unit, second post-processing means for performing post-processing including width alignment, staple binding and adhesive binding on the sheets in bunch form placed on the processing tray, and a collection tray disposed on the downstream side of the processing tray to store the sheets subjected to the post-processing, wherein the first, second and third units are successively provided parallel in a sheet carrying-out direction, the sheet post-processing apparatus further has first coupling means for coupling the first unit and at least one of the second unit and third unit, and second coupling means for coupling the second unit and the third unit, the second unit and the third unit are capable of being pulled out in the sheet carrying-out direction with respect to the first unit by releasing the first coupling means, and the entire or front side of the second unit shifts to the first unit side with respect to the third unit by releasing the second coupling means, wherein the second unit and the third unit are supported to be movable by a pair of front and back guide rails provided in parallel with each other in the sheet carrying-out direction, and the second unit separates parallel from the third unit by releasing the second coupling means.

20. An image forming apparatus comprising:

a main body of the image forming apparatus provided with a paper feed section that sequentially feeds sheets on a stacker, a printing section that performs predetermined print on a sheet from the paper feed section, a fusing section that heats and fuses ink on the sheet fed from the printing section, and a sheet discharge section that sequentially carries the sheet from the fusing section out of a sheet discharge outlet;

an image reading apparatus that is disposed above the main body of the image forming apparatus to read an original image set on a platen; and a sheet post-processing apparatus comprised of a first unit provided with guide means for guiding the sheet that is sequentially carried in from the main body of image forming apparatus, a second unit provided with first post-processing means for performing post-processing to punch and stamp on the sheet that is sequentially carried out of the first unit, and a third unit provided with a processing tray to load sheets that are sequentially carried out through the second unit, second post-processing means for performing post-processing including width alignment, staple binding and adhesive binding on the sheets in bunch form placed on the processing tray, and a collection tray disposed on the downstream side of the processing tray to store the sheets subjected to the post-processing, wherein the first, second and third units are successively provided parallel in a sheet carrying-out direction, the sheet post-processing apparatus further has first coupling means for coupling the first unit and at least one of the second unit and third unit, and second coupling means for coupling the second unit and the third unit, the second unit and the third unit are capable of being pulled out in the sheet carrying-out direction with respect to the first unit by releasing the first coupling means, and the entire or front side of the second unit shifts to the first unit side with respect to the third unit by releasing the second coupling means, and the second unit and the third unit are mutually supported on their rear side swingably by a hinge mechanism, the second unit is supported on its front side by a lock mechanism to be capable of being coupled/released to/from the third unit, and one of the second unit and the third unit is provided with releasing means for releasing coupling of the lock mechanism.

* * * * *